US012123202B2

(12) United States Patent
Boucké et al.

(10) Patent No.: US 12,123,202 B2
(45) **Date of Patent: *Oct. 22, 2024**

(54) MULTI-PURPOSE TILE SYSTEM, TILE COVERING, AND TILE

(71) Applicants: I4F Licensing NV, Turnhout (BE); TOWER IPCO Company Limited, Dublin (IE)

(72) Inventors: Eddy Alberic Boucké, Menen (BE); Jacobus Gerardus Nicolaas Laurentius Veeken, Shanghai (CN)

(73) Assignees: i4F Licensing NV, Turnhout (BE); TOWER IPCO Company Limited, Dublin (IE)

( * ) Notice: Subject to any disclaimer, the term of this patent is extended or adjusted under 35 U.S.C. 154(b) by 0 days.

This patent is subject to a terminal disclaimer.

(21) Appl. No.: 17/737,219

(22) Filed: May 5, 2022

(65) Prior Publication Data

US 2022/0259870 A1 Aug. 18, 2022

Related U.S. Application Data

(63) Continuation of application No. 17/057,144, filed as application No. PCT/EP2019/062703 on May 16, 2019, now Pat. No. 11,326,354.

(30) Foreign Application Priority Data

May 23, 2018 (NL) ..... 2020972

(51) Int. Cl.
*E04F 15/02* (2006.01)

(52) U.S. Cl.
CPC ..... *E04F 15/02038* (2013.01); *E04F 2201/0138* (2013.01); *E04F 2201/0153* (2013.01); *E04F 2201/023* (2013.01); *E04F 2201/042* (2013.01); *E04F 2201/043* (2013.01)

(58) Field of Classification Search
CPC ..... E04F 15/02038; E04F 2201/0138; E04F 2201/0153; E04F 2201/023; E04F 2201/042; E04F 2201/043
USPC ..... 52/578, 589.1, 782.1
See application file for complete search history.

(56) References Cited

U.S. PATENT DOCUMENTS 6,505,452 B1 1/2003 Hannig et al.
6,933,043 B1 * 8/2005 Son ..... B32B 5/022 428/420
7,632,561 B2 * 12/2009 Thiers ..... B44C 1/24 52/592.4
9,314,936 B2 4/2016 Pervan
(Continued)

FOREIGN PATENT DOCUMENTS

CN 2174521 Y 8/1994
CN 101460688 A 6/2009
(Continued)

*Primary Examiner* — Brent W Herring
(74) *Attorney, Agent, or Firm* — The Webb Law Firm

(57) ABSTRACT

The invention relates to a multi-purpose tile system, in particular a floor tile system, comprising a plurality of multi-purpose tiles, in particular floor Liles, wall tiles, or ceiling tiles. The invention also relates to a tile covering, in particular floor covering, ceiling covering, or wall covering, consisting of mutually coupled tiles according to the invention. The invention further relates to a tile for use in multi-purpose tile system according to the invention.

18 Claims, 13 Drawing Sheets

(56) References Cited

U.S. PATENT DOCUMENTS

| | | | | |
|---|---|---|---|---|
| 10,774,540 | B2 * | 9/2020 | Boucke | E04F 15/107 |
| 11,702,848 | B2 * | 7/2023 | Boucké | E04F 13/0894 52/588.1 |
| 2005/0210810 | A1 * | 9/2005 | Pervan | E04F 15/02038 52/578 |
| 2006/0032168 | A1 * | 2/2006 | Thiers | E04F 15/02 52/592.1 |
| 2007/0214741 | A1 | 9/2007 | Llorens Miravet | |
| 2009/0145066 | A1 * | 6/2009 | Pervan | B44C 5/0469 209/11 |
| 2009/0229198 | A1 * | 9/2009 | Gill | E04C 3/04 52/309.1 |
| 2011/0167744 | A1 | 7/2011 | Whispell et al. | |
| 2012/0317911 | A1 * | 12/2012 | Huang | E04F 15/02 52/468 |
| 2013/0025231 | A1 * | 1/2013 | Vermeulen | E04F 15/02038 403/327 |
| 2017/0370109 | A1 | 12/2017 | Devos | |
| 2018/0029407 | A1 | 2/2018 | Yu et al. | |
| 2019/0203481 | A1 * | 7/2019 | Boucke | E04F 15/107 |
| 2020/0131784 | A1 | 4/2020 | Boucke | |
| 2021/0404189 | A1 * | 12/2021 | Boucké | E04F 15/107 |

FOREIGN PATENT DOCUMENTS

| | | | |
|---|---|---|---|
| CN | 103950267 | A | 7/2014 |
| CN | 111042477 | A | 4/2020 |
| DE | 20122032 | U1 | 12/2003 |
| DE | 202011110958 | U1 | 10/2017 |
| JP | S62105250 | U | 7/1987 |
| JP | 2005503502 | A | 2/2005 |
| JP | 2007211584 | A | 8/2007 |
| JP | 2017101550 | A | 6/2017 |
| WO | 03025307 | A1 | 3/2003 |
| WO | 2005098163 | A1 | 10/2005 |
| WO | 2012136021 | A1 | 10/2012 |
| WO | 2015130169 | A1 | 9/2015 |
| WO | 2016113706 | A1 | 7/2016 |
| WO | 2017115202 | A1 | 7/2017 |
| WO | 2017187298 | A2 | 11/2017 |
| WO | 2019101928 | A1 | 5/2019 |
| WO | 2020083615 | A1 | 4/2020 |
| WO | 2020114645 | A1 | 6/2020 |
| WO | 2021045612 | A1 | 3/2021 |

* cited by examiner

MULTI-PURPOSE TILE SYSTEM, TILE COVERING, AND TILE

CROSS-REFERENCE TO RELATED APPLICATIONS

This application is a continuation application of U.S. patent application Ser. No. 17/057,144, filed on Nov. 20, 2020, which is the United States national phase of International Application No. PCT/EP2019/062703 filed May 16, 2019, and claims priority to Netherlands Patent Application No. 2020972 filed May 23, 2018, the disclosures of which are hereby incorporated by reference in their entirety.

BACKGROUND OF THE INVENTION

1. Field of the Invention

The disclosure relates to a multi-purpose tile system, in particular a floor tile system, including a plurality of multi-purpose tiles, in particular floor tiles, wall tiles, or ceiling tiles. The disclosure also relates to a tile covering, in particular floor covering, ceiling covering, or wall covering, consisting of mutually coupled tiles according to the disclosure. The disclosure further relates to a tile for use in multi-purpose tile system according to the disclosure.

2. Discussion of the Related Art

Chevron pattern had appeared in art as design around 4.000 years ago, on the recovered pottery found in Crete, ancient Greece. Chevron has become one of the main pattern designs for art, architecture and flooring later on. Chevron is derived from the French word chèvre ('goat'), translated from the Latin word 'capra' and referring to the famous V-shaped constellation Capricornus ('horned goat') of the zodiac. Obviously, this V-shaped has been the inspiration source of the V-shaped chevron pattern flooring it is still known today. The chevron patterns are typically used in the field of parquet wood flooring, wherein parquet panels are glued or nailed to a subfloor. The chevron floor tiles have the shape of a parallelogram, which is cut from an ordinary rectangular parquet plank, wherein usually both end surfaces of the panel are cut to enclose an angle of 45 degree with a longitudinal axis of the tiles. After installation, the chevron pattern is characterized by a straight separation line dividing the created V-shaped (herringbone) layout in two identical layout parts leading to an elegant, spacious, and even prestigious appearance. A drawback of the known chevron floor tiles is that these tiles are quite vulnerable at their pointed vertex (connecting two edges together). There is a need, however, to develop a interconnectable chevron floor panel, which can be installed relatively easily.

It is a first object to provide a multi-purpose floor system including a plurality of interconnectable tiles for realizing a chevron pattern.

It is a second object to provide a multi-purpose floor system including a plurality of relatively invulnerable interconnectable tiles for realizing a chevron pattern.

SUMMARY OF THE INVENTION

At least one of these objects can be achieved by providing a multi-purpose system, wherein tiles are configured to being joined in a chevron pattern, wherein each tile includes a first pair of opposing edges including a first edge and an opposite second edge; a second pair of opposing edges including a third edge and an opposing fourth edge, wherein: the first edge and the third edge enclose a first acute angle, and wherein the second edge and the fourth edge enclose a second acute angle opposing said first acute angle, and wherein the second edge and the third edge enclose a first obtuse angle, and wherein the first edge and the fourth edge enclose a second obtuse angle opposing said first obtuse angle, and wherein the first pair of opposing edges have pairs of opposing first mechanical coupling means for locking together said tiles at least vertically, and preferably also horizontally, including: a first coupling profile including a sideward tongue extending in a direction substantially parallel to the upper side of the tile, and an opposing second coupling profile including a recess configured for accommodating at least a part of the sideward tongue of a further tile, said recess being defined by an upper lip and a lower lip, wherein said first mechanical coupling profiles allow locking together said tiles by inward angling whereby at least a part of the sideward tongue is received by the recess, and wherein the second pair of opposing edges have pairs of opposing second mechanical coupling means for locking together said tiles vertically and horizontally, including: a third coupling profile, including an upward tongue, at least one upward flank lying at a distance from the upward tongue and an upward groove formed between the upward tongue and the upward flank, wherein at least a part of a side of the upward tongue facing the upward flank is inclined toward the upward flank, and wherein at least a part of a side of the upward tongue facing away from the upward flank optionally includes at least one first locking element, which (optional) first locking element preferably makes integral part of the upward tongue, and a fourth coupling profile, including a downward tongue, at least one downward flank lying at a distance from the downward tongue, and a downward groove formed between the downward tongue and the downward flank, wherein at least a part of a side of the downward tongue facing the downward flank is inclined toward the downward flank, and wherein the downward flank optionally includes at least one second locking element, which (optional) second locking element preferably makes integral part of the downward flank, and adapted for co-action with the at least one first locking element (if applied) of yet a further tile, wherein the second mechanical coupling profiles allow locking together said tiles during inward angling of the first coupling profile of a tile and the second coupling profile of another tile, wherein the fourth coupling profile of the tile to be coupled makes a scissoring movement toward the third coupling profile of yet another tile, leading to locking of the third coupling profile and the fourth coupling profile, wherein each tile includes a substantially rigid base layer at least partially made of a foamed composite including at least one plastic material and at least one filler, wherein the composite and/or the plastic material is preferably a closed cell foam.

The tile system according to the disclosure includes tiles having the shape of a parallelogram, and preferably a rhombus or a rhomboid, which in a joined state will form a chevron pattern. Installation of the tile system by interconnecting said tiles in order to create a tile covering can be realized by inward angling of a sideward tongue of a first tile to be installed into a recess of an already installed second tile, which is typically—though not necessarily—realized by angling down the tile to be installed with respect to the already installed tile, which will lock the first tile and the second tile at least in vertical direction, but preferably also in horizontal direction. During this inward angling of the first tile and the second tile, commonly the fourth coupling profile of the first tile to be installed will be connected (simultaneously) to the third coupling profile of another already installed third tile, which is typically realized by lowering the first tile with respect to the third tile during which the third coupling profile and the fourth coupling profile will be scissored (zipped) into each other, which results in a locking of the first tile with respect to the third tile both in horizontal and vertical direction. Due to the parallelogrammatic shape of the tiles, a chevron pattern can be realized in this manner in a relatively simple and efficient manner compared to the installation of conventional parquet wood tiles. The multi-purpose tiles of the tile system according to the disclosure are relatively inexpensive to manufacture and do not require special skills or training to handle and install, making it attractive for do-it-yourself individuals who have had no previous experience installing tiles. The substantially rigid base layer of each tile is at least partially composed of a foamed composite, preferably a closed cell composite, including at least one plastic material and at least one filler, which provides sufficient rigidity and impact strength to the tile as such, including the vulnerable pointed vertexes. This makes this composite ideally suitable to be applied in parallelogrammatically shaped tiles to realize a durable and undamaged chevron pattern, even by unskilled persons. Conventional materials, like HDF and MDF, are weaker than the aforementioned foamed composite, and will easily lead to breakage and/or damaging of the pointed vertexes, which render these conventional materials to be unsuitable for the purpose of realizing chevron patterns. Hence, the substantially rigid, preferably closed cell foam, plastic material as used as component of the foamed composite in the base layer provides the tile as such a desired rigidity and robustness preventing damaging, and in particular breakage, of the coupling profiles and/or the pointed vertexes (during normal use). An additional advantage of using a foam plastic material is that the presence closed cells not only leads to improved rigidity and improved impact resistance, but also to reduced density and lighter weight in comparison with dimensionally similar non-foam plastic material and in comparison with conventional materials like HDF and MDF. It is imaginable, although commonly less preferred that the substantially rigid base layer is at least partially made of an open cell foam plastic material, or a combination of an open cell foam plastic material and a closed cell foam plastic material. The rigidity of the composite of the base layer may further be improved by applying a toughening agent, wherein the base layer of closed cell foam plastic material may contain, for example, approximately 3% to 9% by weight of the toughening agent. Because the coupling profiles are given a specific form, the substantially complementarily formed first and second coupling profiles and the substantially complementarily formed third and fourth coupling profiles of adjacent tiles can be coupled to each other relatively simply, but durably and efficiently. During coupling of adjacent tiles a force will here be exerted on one or both complementary third and fourth coupling profiles, whereby the one or both coupling profiles will slightly and temporarily (resiliently) deform to some extent, as a consequence of which the volume taken up by the downward groove and/or upward groove will be increased such that the upward tongue and the downward tongue can be arranged relatively simply in respectively the downward groove and the upward groove. By subsequently allowing the forced coupling profiles to move back (resiliently) to the original position a reliable, locked coupling will be realized between the third and fourth coupling profiles, and thereby between the two tiles. Hence, the third coupling profile and/or fourth coupling profile may be considered as a substantially rigid coupling profiles with a restricted degree of resiliency to allow coupling. Due to the rigidity of the base layer, and due to the fact that the at least a part of the coupling parts will typically be integrated with said base layer (at least in some embodiments), the resiliency of the coupling parts will commonly be very restricted though sufficient to allow tiles to be coupled and uncoupled. This locked coupling, wherein both coupling parts mutually engage in relatively reliable manner, and which commonly results in a locking effect between two tiles both in horizontal direction and in vertical direction, will preferably be without play, which counteracts the risk of the occurrence of creaking noises. Hereby, it is aspired to reduce this risk by a suitable design of the profiles of the coupling parts, such that the risk of said undesired noises is reduced even if no sliding agent is applied, which, however, does not exclude that a sliding agent still can be applied on the coupling parts of the tiles according to the disclosure. Moreover, an additional advantage of the foamed composite of the base layer is that this composite has waterproof properties, which makes the tiles suitable both for indoor and outdoor use. Conventional HDF/MDF absorb water and will further weaken during wettening, which will further decrease the rigidity of the tiles, and in particular the rigidity of the (even more) vulnerable pointed vertexes. An additional property of the foamed composite is the relatively low density compared to conventional materials, leading to light-weight tiles, which is not only advantageous from an economic point of view, but which also expands the applicability of the floor system according to disclosure, for example in or on aircrafts, vehicles and vessels, in particular ships. The tile system according to the disclosure can thus be used for different purposes. Typically the light-weight multi-purpose tiles are used to realize a ceiling covering, a wall covering, and/or a floor covering, or, for example, as covering of a piece of furniture.

The tiles of the tile system according to the disclosure may also be referred to as panels. The base layer may also be referred to as core layer. The coupling profiles may also be referred to as coupling parts or as connecting profiles. By "complementary" coupling profiles is meant that these coupling profiles can cooperate with each other. However, to this end, the complementary coupling profiles do not necessarily have to have perfectly complementary forms. By locking in "vertical direction" is meant locking in a direction perpendicular to the plane of the tile. By locking in "horizontal direction" is meant locking in a direction perpendicular to the respective coupled edges of two tiles and parallel to or falling together with the plane defined by the tiles. In case in this document reference is made to a "floor tile" or "floor panel", these expressions may be replaced by expressions like "tile", "wall tile", "ceiling tile", "covering tile". In the context of this document, the expressions "foamed composite" and "foamed plastic material" (or "foam plastic material") are interchangeable, wherein in fact the foamed composite includes a foamed mixture including at least one (thermos)plastic material and at least one filler. Typically, the plastic material technically allows the foam to be formed, though wherein the formed foam as such is formed by a foam matrix including both at least one (thermos)plastic material and at least one filler.

When realizing a chevron pattern, it is advantageous in case the system includes two different types of tiles (A and B respectively), and wherein the first mechanical coupling means of one type of tile along the first pair of opposite edges are arranged in a mirror-inverted manner relative to the corresponding first mechanical coupling means along the same first pair of opposite edge portions of the other type of tile. An advantage of identical and mirror-inverted tiles to be used in a system according to the disclosure is that the tiles can be produced easily, wherein, for example, the second mechanical coupling means of both the A and B type tiles can be machined, for instance, in a first machine. Then the A type tiles proceed to another machine where the first mechanical coupling means is machined. The boards that are to be provided with mirror-inverted first mechanical coupling means, for instance the B type tiles, are however rotated through 180 in the same plane before machining of the first mechanical coupling means. Thus the two types of board A and B can be manufactured using the same machines and the same set of tools. Distinctive visual markings, for example coloured labels, symbolic labels, (pre-attached) differently coloured backing layers, and/or text labels, may be applied to different tile types to allow a user to easily recognize the different tiles types during installation. Preferably the visual markings are not visible in a coupled condition of the tiles (from a top view). A visual marking may, for example, be applied onto the upper side of the upward tongue and/or inside the upward groove and/or inside the downward groove. It is imaginable that the system according to the disclosure includes more than two different types of tiles.

In a preferred configuration, at least one tile has a configuration wherein: the first coupling profile is arranged at the first edge; the second coupling profile is arranged at the second edge; the third coupling profile is arranged at the third edge; and the fourth coupling profile is arranged at the fourth edge. This tile could, for example, be referred to as an A type tile. In another preferred configuration, at least one tile has a configuration wherein: the first coupling profile is arranged at the second edge; the second coupling profile is arranged at the first edge; the third coupling profile is arranged at the third edge; and the fourth coupling profile is arranged at the fourth edge. This tile could, for example, be referred to as a B type tile.

In a preferred embodiment of a tile of the tile system according to the disclosure, the first coupling profile includes a sideward tongue extending in a direction substantially parallel to the upper side of the tile, the bottom front region of said sideward tongue, the bottom back region of said tongue being configured as bearing region, wherein the bottom back region is located closer to the level of the upper side of the tile than a lowest part of the bottom front region, and wherein the second coupling profile includes a recess for accommodating at least a part of the sideward tongue of a further tile, said recess being defined by an upper lip and a lower lip, said lower lip being provided with a upwardly protruding shoulder for supporting and/or facing the bearing region of the sideward tongue, wherein the sideward tongue being designed such that locking takes place by an introduction movement into the recess of the sideward tongue a further tile and a angling down movement about an axis parallel to the first coupling profile, as a result of which a top side of the sideward tongue will engage the upper lip and the bearing region of the sideward tongue will be supported by and/or will be facing the shoulder of the lower lip, leading to locking of adjacent tiles at the first and second edges in both horizontal direction and vertical direction. At the first and second edges, a locking in horizontal direction between two tiles is established by the presence of the upwardly protruding shoulder, which prevents the bottom front region of the sideward tongue (male part) to be displaced in a horizontal direction with respect to the complementary recess (female part) and the upwardly protruding shoulder. Hence, the shoulder locks the bottom front region of the sideward tongue in place. Preferably, the shoulder has a substantially flat upper surface. An upper surface of the shoulder is preferably oriented substantially horizontally, though may also be inclined, either such that this upper surface faces the upper lip or that this upper surface faces away from the upper lip. A shoulder (side) wall facing or directed towards the tile core is preferably sufficiently inclined (steep) to act as locking surface for locking connected tiles in horizontal direction. Preferably, at least an upper end part of said (inner) shoulder wall, connecting to an upper shoulder surface, extends in a direction of at least 45 degrees, more preferably at least 60 degrees with respect to a horizontal plane, which will secure a firm locking in horizontal direction. Said shoulder wall can be flat though is preferably curved, since a curved shoulder wall facilitates insertion of a sideward tongue of a first tile into the recess of the second edge of a second tile. Preferably, a bottom region of the lower lip extending between the core and the shoulder is at least partially curved (rounded), wherein more preferably the shape of said bottom region of the lower lip is substantially complementary to the shape of the at least partially rounded bottom front region of the sideward tongue. The complementary rounded surfaces will act as sliding surfaces during coupling of the tiles. The upper surface has a substantially complementary shape with respect to a corresponding bottom region of the lower lip. A locking in vertical direction at the first and second edges of two tiles is established by the engagement of a top surface of the sideward tongue to a bottom surface of the upper lip acting as locking surface. In fact, the upper lip prevents the inserted sideward tongue to be displaced in vertical direction. After coupling, a top surface of the sideward tongue preferably at least partially engages a bottom surface of the upper lip. After coupling, a top surface of the sideward preferably engages the complete bottom surface of the upper lip. This partial or complete engagement prevents play between coupled tiles. Hence, tiles can be coupled free of play at the first edge and the second edge.

In a preferred embodiment of a tile of the tile system according to the disclosure, the third coupling profile includes an upward tongue, at least one upward flank lying at a distance from the upward tongue and an upward groove formed between the upward tongue and the upward flank, wherein at least a part of a side of the upward tongue facing the upward flank is inclined toward the upward flank, and wherein at least a part of a side of the upward tongue facing away from the upward flank includes at least one first locking element, which preferably makes integral part of the upward tongue, and wherein the fourth coupling profile includes a downward tongue, at least one downward flank lying at a distance from the downward tongue, and a downward groove formed between the downward tongue and the downward flank, wherein at least a part of a side of the downward tongue facing the downward flank is inclined toward the downward flank, and wherein the downward flank includes at least one second locking element, which preferably makes integral part of the downward flank, and adapted for co-action with the at least one first locking element of the third coupling profile of yet a further tile, the third and fourth coupling profiles being designed such that locking takes place during angling down of a tile to be coupled at the first coupling profile to the second coupling profile of a further tile, wherein the fourth coupling profile of the tile to be coupled makes a scissoring movement toward a third coupling profile of yet another tile, such that the downward tongue of the fourth coupling profile of the tile to be coupled will be forced into the upward groove of the third coupling profile of said other tile and the upward tongue of said other tile will be forced into the downward groove of the tile the be coupled, by deformation of the third coupling profile and/or the coupling profile edge, leading to locking of adjacent tiles at the third and fourth coupling profiles in both horizontal direction and vertical direction.

Typically, the length of the first edge and the length of the second edge of a tile are substantially identical. It is also typical that the length of the third edge and the length of the fourth edge of a tile are substantially identical. It is imaginable that the length of the first edge and the length of the second edge of a tile are substantially identical to the length of the third edge and the fourth edge of said tile. This configuration will lead to a rhombically shaped tile. However, it is commonly more preferred that the length of the first edge and the length of the second edge of a tile are greater than the length of the third edge and the fourth edge of said tile. This configuration will lead to an oblong tile with a parallelogrammatic shape.

The first acute angle and the second acute angle of each tile of the tile system according to the disclosure, are preferably situated between 30 and 60 degrees, more preferably between 40 and 50 degrees, and are in particular preferably equal to approximately 45 degrees (+/−1 or 2 degrees). The first obtuse angle and the second obtuse angle of each tile of the tile system according to the disclosure are preferably situated between 120 and 150 degrees, more preferably between 130 and 140 degrees, are in particular preferably equal to approximately 135 degrees (+/−1 or 2 degrees).

Each tile preferably includes an upper substrate affixed to an upper side the base layer, wherein said substrate preferably includes a decorative layer. The upper substrate is preferably at least partially made of at least one material selected from the group consisting of: metals, alloys, macromolecular materials such as vinyl monomer copolymers and/or homopolymers; condensation polymers such as polyesters, polyamides, polyimides, epoxy resins, phenol-formaldehyde resins, urea formaldehyde resins; natural macromolecular materials or modified derivatives thereof such as plant fibres, animal fibres, mineral fibres, ceramic fibres and carbon fibres. Here, the vinyl monomer copolymers and/or homo-polymers are preferably selected from the group consisting of polyethylene, polyvinyl chloride (PVC), polystyrene, polymethacrylates, polyacrylates, polyacrylamides, ABS, (acrylonitrile-butadiene-styrene) copolymers, polypropylene, ethylene-propylene copolymers, polyvinylidene chloride, polytetrafluoroethylene, polyvinylidene fluoride, hexafluoropropene, and styrene-maleic anhydride copolymers, and derivates thereof. The upper substrate most preferably includes polyethylene or polyvinyl chloride (PVC). The polyethylene can be low density polyethylene, medium density polyethylene, high density polyethylene or ultra-high density polyethylene. The upper substrate layer can also include filler materials and other additives that improve the physical properties and/or chemical properties and/or the processability of the product. These additives include known toughening agents, plasticizing agents, reinforcing agents, anti-mildew (antiseptic) agents, flame-retardant agents, and the like. The decorative layer of the one or more upper substrates is preferably formed by an ink layer digitally printed onto a supporting layer, such as the base layer or a primer layer applied onto the base layer. It is also conceivable that the decorative layer of the one or more upper substrates is formed by a printed synthetic film, such as a printed PET film or a printed PVC film.

In a preferred embodiment, at least one tile includes a plurality of strip shaped upper substrates affixed, either directly or indirectly, to an upper side the base layer, wherein said upper substrates are arranged side by side in the same plane, preferably at least two upper substrates in a parallel configuration, and wherein facing longitudinal edges of at least two strip shaped upper substrates are provided, near the top side, with a bevel. Preferably, each upper substrate, preferably each strip shaped upper substrate includes: a decorative layer and an abrasion resistant wear layer covering said decorative layer, wherein a top surface of said wear layer is the top surface of said tile, and wherein the wear layer is a transparent and/or translucent material, such that decorative layer is visible through the transparent wear layer. Preferably, facing longitudinal edges of at least two strip shaped upper substrates are (each) provided, near the top side, with a bevel. The bevel is applied to prevent visible seam formation, and secures a seamless engagement of adjacent upper substrates. Said bevel is preferably formed by a cut-away portion and/or imprinted portion and/or chamfered portion of a wear layer covering the decorative layer. Preferably, the bevel is positioned above the decorative layer. Preferably, the bevel leaves the decorative layer intact. Preferably, a transparent finishing layer situated in between the decorative layer and the wear layer. This finishing layer may be made of thermoplastic material, such as PVC or PET. Preferably, each strip shaped upper substrate includes a back layer situated in between the base layer and the decorative layer. The back layer is preferably made of thermoplastic material, such as PVC or PET. Preferably, the back layer thickness is at least 50% of the thickness of the upper substrate. The back layer is preferably glued, fused, or welded to the base layer or to an intermediate layer, such as a primer layer, affixed to the top surface of the base layer. Preferably, the width of a top portion of the back layer is larger than the width of a bottom portion of the back layer, typically as seen in cross-section. Preferably, by cutting-away (trimming) and/or deforming said bottom portion of the longitudinal edge, an improved seamless and tight engagement of adjacent upper substrates, at least near the top surface(s), can be obtained. Preferably, the bottom portion of opposing longitudinal edges of the back layer is chamfered. Said chamfer is preferably more inclined towards a (vertical) plane perpendicular to the plane defined by the tile than towards a (horizontal) plane parallel to the plane defined by the tile. The chamfer is preferably inclined inwardly in downward direction (towards the base layer). During production, the upper substrates will be affixed, directly or indirectly, to the upper surface of the base layer, wherein the upper substrate are preferably positioned rather tightly next to each other. In case said narrowing width of the bottom portion of the upper substrate(s) is/are applied, it is imaginable to small air channels are formed in between adjacent upper substrates, at or near the bottom side of said upper substrates. It is imaginable, and it may also be preferable, that short edges of the upper substrates together form a pair of opposing edges of the tile, preferably a pair of long edges of the tile. Here, it is preferred that the short edges of the upper substrate(s) is/are also provided with a bevel, near the top surface, which allows or facilitates adjacent tiles to engage seamless to each other.

The upper substrate typically includes a decorative layer and an abrasion resistant wear layer covering said decorative layer, wherein a top surface of said wear layer is the top surface of said tile, and wherein the wear layer is a transparent material, such that decorative layer is visible through the transparent wear layer.

The thickness of the upper substrate typically varies from about 0.1 to 3.5 mm, preferably from about 0.5 to 3.2 mm, more preferably from about 1 to 3 mm, and most preferably from about 2 to 2.5 mm. The thickness ratio of the foam base layer to the upper substrate commonly varies from about 1 to 15:0.1 to 3.5, preferably from about 1.5 to 10:0.5 to 3.2, more preferably from about 1.5 to 8:1 to 3, and most preferably from about 2 to 8:2 to 2.5, respectively.

Each tile may include an adhesive layer to affix the upper substrate, directly or indirectly, onto the base layer. The adhesive layer can be any well-known bonding agent or binder capable of bonding together the upper substrate and the foam base layer, for example polyurethanes, epoxy resins, polyacrylates, ethylene-vinyl acetate copolymers, ethylene-acrylic acid copolymers, and the like. Preferably, the adhesive layer is a hot-melt bonding agent.

The decorative layer or design layer, which may be part of the upper substrate as mentioned above, can include any suitable known plastic material such as a known formulation of PVC resin, stabilizer, plasticizer and other additives that are well known in the art. The design layer can be formed with or printed with printed patterns, such as wood grains, metal or stone design and fibrous patterns or three-dimensional figures. Thus the design layer can provide the tile with a three dimensional appearance that resembles heavier products such as granite, stone or metal. The thickness of the design layer typically varies from about 0.01 to 0.1 mm, preferably from about 0.015 to 0.08 mm, more preferably from about 0.2 to 0.7 mm, and most preferably from about 0.02 to 0.5 mm. The wear layer that typically forms the upper surface of the tile can include any suitable known abrasion-resistant material, such as an abrasion-resistant macromolecular material coated onto the layer beneath it, or a known ceramic bead coating. If the wear layer is furnished in layer form, it can be bonded to the layer beneath it. The wear layer can also include an organic polymer layer and/or inorganic material layer, such as an ultraviolet coating or a combination of another organic polymer layer and an ultraviolet coating. For example, an ultraviolet paint capable of improving the surface scratch resistance, glossiness, antimicrobial resistance and other properties of the product. Other organic polymers including polyvinyl chloride resins or other polymers such as vinyl resins, and a suitable amount of plasticizing agent and other processing additives can be included, as needed.

In a preferred embodiment, at least one tile includes a plurality of strip shaped upper substrates directly or indirectly affixed to an upper side the base layer, wherein said upper substrate are arranged side by side in the same plane. Here, preferably at least two upper substrates are oriented in a parallel configuration. Alternatively or additionally, at least two upper substrate are oriented in a perpendicular orientation. Preferably, at least one upper substrate is affixed to the upper side of the base layer, such that a longitudinal axis of said upper substrate is parallel with respect one pair of opposing edges of the tile. Here, the plurality of upper substrates preferably substantially completely cover the upper surface of the base layer, and more preferably extend from the first edge to the second edge of the tile. Each of the plurality of upper substrates preferably includes a decorative layer, wherein the decorative layers of at least two adjacently arranged upper substrates preferably have different appearances. The application of a plurality of strip shaped upper substrates, are arranged side by side in the same plane and directly or indirectly affixed to the base layer will create the attractive aesthetical effect that the chevron tiles is defined by the strip shaped upper substrates as such, while having the advantages that during installation merely the tiles as such will have to be coupled rather than the strip shaped upper substrate, which would be time-consuming and expensive.

Preferably, the base layer includes at least one foaming agent. The at least one foaming agent takes care of foaming of the base layer, which will reduce the density of the base layer. This will lead to light weight tiles, which are lighter weight in comparison with tile which are dimensionally similar and which have a non-foamed base layer. The preferred foaming agent depends on the (thermo)plastic material used in the base layer, as well as on the desired foam ratio, foam structure, and preferably also the desired (or required) foam temperature to realise the desired foam ratio and/or foam structure. To this end, it may be advantageous to apply a plurality of foaming agents configured to foam the base layer at different temperatures, respectively. This will allow the foamed base layer to be realized in a more gradual, and more controller manner. Examples of two different foaming agents which may be present (simultaneously) in the base layer are azidicarbonamide (ADCA) and sodium bicarbonate. These foaming agents are preferred to be used together due to their synergy. Both components exhibit very different decomposition behaviour. ADCA decomposes exothermically, and will lose the major mass over a narrow, but relatively high, temperature range of 190-210 degrees Celsius. This decomposition temperature can be, and is preferably, reduced by activating ADCA by using ADCA with an activator, also referred to as a kicker. Suitable activators for ADCA are e.g. dibasic lead phosphite, zinc oxide, zinc stearate, calcium carbonate, magnesium oxide, silica, and other mineral compounds. Sodium bicarbonate was found to decompose over a broader, but relatively low, temperature range of 100-140 degrees Celsius. The actual decomposition temperature can be, and is preferably, lowered by using e.g. citric acid, preferably anhydrous citric acid, as activator. The use of ADCA results in a rapid decrease of foam density. The synergism between the two foaming agents results in the fact that the combination of ADCA and sodium bicarbonate leads to a relatively low foam density with a fine even cell structure. The generation of this fine cell structure has led to the conclusion that gas bubbles, in particular nitrogen gas, produced from the decomposition of ADCA act as sites for the nucleation of carbon dioxide bubbles resulting from the decomposition.

In this respect, it is often also advantageous to apply at least one modifying agent, such as methyl methacrylate (MMA) and/or butyl acrylate-methyl methacrylate (BAMMA), in order to keep the foam structure relatively consistent throughout the base layer. Preferably, the weight content of the modifying agent, preferably MMA or BAMMA, is situated between 2 and 5%, more preferably between 3 and 4%.

Foam plastic materials suitable for forming the foam base layer may include polyurethane, polyamide copolymers, polystyrene, polyvinyl chloride (PVC), polypropylene and polyethylene foamed plastics, all of which have good moulding processability. Preferably, chlorinated PVC (CPVC) and/or chlorinated polyethylene (CPE) and/or another chlorinated thermoplastic material is/are used to further improve the hardness and rigidity of the base layers, and of the tiles as such, reducing the vulnerability of the pointed vertexes of each tile, which makes the tile even more suitable to be used as parallelogrammatic/rhombic tile for realizing chevron patterns. Polyvinyl chloride (PVC) foam materials are especially suitable for forming the foam base layer because they are chemically stable, corrosion resistant, and have excellent flame-retardant properties. The plastic material used as foam plastic material in the base layer is preferably free of any plasticizer in order to increase the desired rigidity of the base layer, which is, moreover, also favourable from an environmental point of view. Preferably, the composite of the base layer includes between 35 and 50%, and more preferably between 40 and 45%, thermoplastic material, in particular PVC.

The base layer may also at least partially be composed of a (PVC-free) thermoplastic composition. This thermoplastic composition may include a polymer matrix including (a) at least one ionomer and/or at least one acid copolymer; and (b) at least one styrenic thermoplastic polymer, and, optionally, at least one filler. An ionomer is understood as being a copolymer that includes repeat units of electrically neutral and ionized units. Ionized units of ionomers may be in particular carboxylic acid groups that are partially neutralized with metal cations. Ionic groups, usually present in low amounts (typically less than 15 mol % of constitutional units), cause micro-phase separation of ionic domains from the continuous polymer phase and act as physical crosslinks. The result is an ionically strengthened thermoplastic with enhanced physical properties compared to conventional plastics.

The composite of the base layer preferably includes one or more fillers, wherein at least one filler is selected from the group consisting of: talc, chalk, wood, calcium carbonate, titanium dioxide, calcined clay, porcelain, a(nother) mineral filler, and a(nother) natural filler. The filler, preferably chosen from the above group, may be formed by fibres and/or may be formed by dust-like particles. Here, the expression "dust" is understood as small dust-like particles (powder), like wood dust, cork dust, or non-wood dust, like mineral dust, stone powder, in particular cement. The average particle size of the dust is preferably between 14 and 20 micron, more preferably between 16 and 18 micron. The primary role of (this kind of) filler, as mentioned in this paragraph, is to provide the base layer, and the parallelogrammatic/rhombic tile(s) as such, sufficient hardness. This will allow the tiles, including their—commonly relatively vulnerable—pointed vertexes, to realize chevron patterns in a reliable and durable manner. Moreover, this kind of filler will typically also improve the impact strength of the base layer and of the tile(s) as such. The weight content of this kind of filler in the composite is preferably between 35 and 75%, more preferably between 40 and 48%, most preferably between 45 and 48%, in case the composite is a foamed composite, and more preferably between 65 and 70% in case the composite is a non-foamed (solid) composite.

In a particular preferred embodiment, the composite of the base layer includes 40-45% by weight PVC and 45-48% by weight mineral filler, in particular calcium carbonate (chalk). Research has shown that this combination of materials and material ranges provides excellent properties to the base layers in terms of hardness (robustness/rigidity) and flexibility to further reduce the risk of breakage of the panel during use, in particular during coupling. A higher content of calcium carbonate (>48%) will typically lead to a fragile composition which may break rather easily, while a lower content of calcium carbonate (<45%) typically leads to a composite which is too flexible and not sufficiently hard (rigid) to allow the panels to function in a proper manner. A lower content of PVC (<40%) will typically leads to a too rigid composite to allow the panels to function properly, and, moreover, as PVC acts as a binding agent (binding matrix) such a relatively low content typically affects proper and stable binding of the composite as such. Preferably, the weight content of the modifying agent, preferably MMA, present in the composite, is situated between 2 and 5%, more preferably between 3 and 4%.

In an alternative configuration of the tile system according to the invention, each tile includes a substantially rigid base layer at least partially made of a non-foamed (solid) composite including at least one plastic material and at least one filler. A solid base layer may lead to an improved tile strength, and hence a reduced vulnerability of the pointed vertexes, and may further improve the suitability to use the tiles to realize a chevron pattern. A drawback of applying a solid composite in the base layer instead of a foamed composite in the base layer is that the tile weight will increase (in case base layers of identical thicknesses would be applied), which may lead to higher handling costs, and higher material costs.

Preferably, the composite of the base layer includes at least one filler of the base layer is selected from the group consisting of: a salt, a stearate salt, calcium stearate, and zinc stearate. Stearates have the function of a stabilizer, and may act as foaming agent activator, and lead to a more beneficial processing temperature, and counteract decomposition of components of the composite during processing and after processing, which therefore provide long-term stability. Instead of or in addition to a stearate, for example calcium zinc or zinc oxide may also be used as stabilizer. The weight content of the stabilizer(s), in particular zinc stearate, in the composite will preferably be between 1 and 5%, and more preferably between 1.5 and 4%, most preferably between 1 and 2%.

The composite of the base layer preferably includes at least one impact modifier including at least one alkyl methacrylates, wherein said alkyl methacrylate is preferably chosen from the group consisting of: methyl methacrylate, ethyl methacrylate, propyl methacrylate, isopropyl methacrylate, t-butyl methacrylate and isobutyl methacrylate. The impact modifier typically improves the product performance, in particular the impact resistance. Moreover, the impact modifier typically toughens the base layer and can therefore also be seen as toughening agent, which further reduces the risk of breakage. Often, the modifier also facilitates the production process, for example, as already addressed above, in order to control the formation of the foam with a relatively consistent (constant) foam structure. The weight content of the impact modifier in the composite will preferably be between 1 and 9%, and more preferably between 3 and 6%. Preferably, the substantially complete base layer is formed by the foamed composite.

At least one plastic material used in the base layer is preferably free of any plasticizer in order to increase the desired rigidity of the base layer, which is, moreover, also favourable from an environmental point of view.

The density of the foam base layer typically varies from about 0.1 to 1.5 grams/cm3, preferably from about 0.2 to 1.4 grams/cm3, more preferably from about 0.3 to 1.3 grams/cm3, even more preferably from about 0.4 to 1.2 grams/cm3, even more preferably from about 0.5 to 1.2 grams/cm3, and most preferably from about 0.6 to 1.2 grams/cm3. Preferably, the foam has a relatively uniform (closed or open) cell distribution, at least in its center portion and possibly also at the upper portion and bottom portion. The upper portion and bottom portion of the foam base layer may have a larger density than the center portion of the foam base layer.

The plastic foam used in the base layer preferably has an elastic modulus of more than 700 MPa (at a temperature of 23 degrees Celsius and a relative humidity of 50%). This will commonly sufficiently rigidity to the base layer, and hence to the parallelogrammatic/rhombic tile as such.

The density of the base layer preferably varies along the height of the base layer. This may positively influence the acoustic (sound-dampening) properties of the tiles as such. Preferably, at a top section (top portion) and/or a bottom section (bottom portion) of the foamed base layer a crust layer may be formed. This at least one crust layer may form integral part of the base layer. More preferably, both the top section and the bottom section of the base layer form a crust layer enclosing the foam structure. The crust layer is a relatively closed (reduced porosity, or even free of bubbles (cells)), and hence forms a relatively rigid (sub)layer, compared to the more porous foam structure. Commonly, though not necessary, the crust layer is formed by sealing (searing) the bottom and top surface of the core layer. Preferably the thickness of each crust layer is between 0.01 and 1 mm, preferably between 0.1 and 0.8 mm, more preferably between 0.4 and 0.6 mm. A too thick crust will lead to a higher average density of the core layer which increases both the costs and the rigidity of the core layer. A center section (center portion) of the foamed base layer is enclosed by both crust layers. Preferably the thickness of the center section is at least 40%, more preferably at least 50% of the thickness of a crust layer. In general, it is indicated that the average cell size of the foamed base layer, or at least a part thereof (e.g. within the center portion of the base layer) is preferably situated in between 60 and 140 micron, more preferably between 80 and 120 micron. Preferably, the cell size of the foamed base layer, or at least a part thereof (e.g. within the center portion of the base layer) has a relatively narrow cell distribution ranging from 60 to 140 micron, more preferably from 80 to 120 micron. This narrow cell distribution can, for example, be obtained by using a combination of foaming agents, wherein the decomposition temperatures of the foaming agents are mutually different.

The thickness of the base layer (core layer) as such is preferably between 2 and 10 mm, more preferably between 3 and 8 mm, and is typically approximately 4 or 5 mm. Preferably, a top section and/or a bottom section of the (composite) base layer forms a crust layer having a porosity which is less than the porosity of the closed cell foam plastic material of the base layer, wherein the thickness of each crust layer is preferably between 0.01 and 1 mm, preferably between 0.1 and 0.8 mm.

Preferably, each tile includes at least one backing layer affixed to a bottom side of the base layer, wherein said at least one backing layer at least partially made of a flexible material, preferably an elastomer. The thickness of the backing layer typically varies from about 0.1 to 2.5 mm. Non-limiting examples of materials whereof the backing layer can be made of are polyethylene, cork, polyurethane and ethylene-vinyl acetate. The thickness of a polyethylene backing layer is for example typically 2 mm or smaller. The backing layer commonly provides additional robustness and impact resistances to each tile as such, which increases the durability of the tiles. Moreover, the (flexible) backing layer may increase the acoustic (sound-dampening) properties of the tiles. In a particular embodiment, the base layer is composed of a plurality of separate base layer segments affixed to said at least one backing layer, preferably such that said base layer segments are mutually hingeable. The lightweight features of the tiles are advantageous for obtaining a secure bond when installing the tile on vertical wall surfaces. It is also especially easy to install the tile at vertical corners, such as at inside corners of intersecting walls, pieces of furniture, and at outside corners, such as at entry ways. An inside or outside corner installation is accomplished by forming a groove in the foam base layer of the tile to facilitate bending or folding of the tile.

At least one reinforcing layer may be situated in between the base layer and the upper substrate. This may lead to further improvement of the rigidity of the tiles as such. This may also lead to improvement of the acoustic (sound-dampening) properties of the tiles. The reinforcement layer may include a woven or non-woven fibre material, for example a glass fibre material. They may have a thickness of 0.2-0.4 mm. It is also conceivable that each tile includes a plurality of (commonly thinner) base layers stacked on top of each other, wherein, optionally, at least one reinforcing layer is situated in between two adjacent base layers. Preferably, the density of the reinforcing layer is preferably situated between 1.000 and 2.000 kg/m3, preferably between 1.400- and 1.900 kg/m3, and more preferably between 1.400-1.700 kg/m3.

It is also imaginable that the base layer includes a laminate of composite layers stacked on top of each other. Such a multi-layer base layer may, for example, be formed by co-extrusion. The different composite layers of the base layer may have a different composition. However, it is also imaginable that the composition of the different layer of the base layer is identical, though wherein the structure of different layer is different. It is, for example, imaginable that at least one composite layer of the base layer has a (rather) solid structure, while at least one other composite layer of the base layer has a foam structure. It is in particular imaginable, and this may also be preferably, that the multilayer base layer includes at least two solid composite layer enclosing at least one foam composite layer.

Preferably, the complete first mechanical coupling means and/or the complete second mechanical coupling means is/are integrally connected to the base layer. This may also be understood as that the first mechanical coupling means and/or the complete second mechanical coupling means is/are integrally formed within and/or formed by the base layer.

As already addressed above, although the third coupling profile and/or the fourth coupling profile are predominantly rigid, the third coupling profile and/or the fourth coupling profile allow (slight) deformation during coupling and uncoupling, which will facilitate coupling and uncoupling significantly.

During coupling and uncoupling the coupling parts will commonly be inclined to deform at or in their weakest section. To this end, at least one coupling part of the first coupling part and second coupling part preferably includes a bridge connecting the tongue of said coupling element to the base layer, wherein the minimum thickness of the bridge is smaller than the minimum width of the tongue. This will force the bridge(s) rather than the tongue itself to be slightly deformed during coupling and uncoupling, which is commonly in favour of the durability (and shape stability) of the tongues, and hence of the durability and reliability of the coupling realized between two tiles.

A lower side (lower surface) of an upper bridge of the second coupling part defining an upper side (upper surface) of the downward groove may be at least partially inclined, and preferably extends downward towards the core of the tile. The upper side (upper surface) of the upward tongue may, as well, be at least partially inclined, wherein the inclination of this upper side of the upward tongue and the inclination of the upper bridge of the second coupling part may be identical, though wherein it is also imaginable that both inclinations for instance mutually enclose an angle between 0 and 5 degrees. The inclination of the bridge part of the second coupling part creates a natural weakened area of the bridge part, where deformation is likely to occur.

Each of the upward tongue and the downward tongue is preferably substantially rigid, which means that the tongues are not configured to be subjected to deformation. The tongues as such are relatively stiff and hence non-flexible. Moreover, the tongues are preferably substantially solid, which means that the tongues are substantially massive and thus completely filled with material and are therefore not provided with grooves at an upper surface which would weaken the construction of the tongue and hence of the tile connection to be realised. By applying a rigid, solid tongue a relatively firm and durable tongue is obtained by means of which a reliable and the durable tile connection can be realised without using separate, additional components to realise a durable connection.

In an embodiment of the tile, at least a part of the upward flank adjoining the upper side of the tile is adapted to make contact with at least a part of the downward tongue adjoining the upper side of another tile in a coupled state of these tiles. Engagement of these surfaces will lead to an increase of the effective contact surface between the coupling parts and hence to an increase of stability and sturdiness of the connection between two tiles. In a favourable embodiment the upper side of the tile is adapted to engage substantially seamless to the upper side of another tile, as a result of which a seamless connection between two tiles, and in particular the upper surfaces thereof, can be realised.

In another embodiment the first locking element is positioned at a distance from an upper side of the upward tongue. This is favourable, since this will commonly result in the situation that the first locking element is positioned at a lower level than the upward aligning edge of the tile, which has the advantage that the maximum deformation of the second coupling part can be reduced, whereas the connection process and deformation process can be executed in successive steps. Less deformation leads to less material stress which is in favour of the life span of the coupling part(s) and hence of the tile(s). In this embodiment the second locking element is complementary positioned at a distance from an upper side of the downward groove.

In yet another embodiment the effective height of the downward aligned edge is larger than the effective height of the upward tongue. This commonly results in the situation that the downward aligning edge of a tile does not engage another tile in case of a pre-aligned state (intermediate state). The position-selective contactless pre-alignment does prevent or counteract forcing the downward aligning edge of a tile along the upper surface of another tile, which could damage the tiles.

In an embodiment the mutual angle enclosed by at least a part of a side of the upward tongue facing toward the upward flank and the upward flank (and/or the normal of the upper side of the base layer) is substantially equal to the mutual angle enclosed by at least a part of a side of the downward tongue facing toward the downward flank and the downward flank (and/or the normal of the lower side of the base layer). A close-fitting connection of the two tongue parts to each other can hereby be realized, this generally enhancing the firmness of the coupling between the two tiles. In an embodiment variant the angle enclosed by on the one hand the direction in which at least a part of a side of the upward tongue facing toward the upward flank extends and on the other the upward flank and/or the normal of the upper side of the base layer lies between 0 and 60 degrees, in particular between 0 and 45 degrees, more particularly between 0 and 10 degrees. In another embodiment variant the angle enclosed by on the one hand the direction in which at least a part of a side of the downward tongue facing toward the downward flank extends and on the other hand the downward flank and/or the normal of the lower side of the base layer lies between 0 and 60 degrees, in particular between 0 and 45 degrees, more particularly between 0 and 10 degrees. The eventual inclination of the tongue side facing toward the flank usually also depends on the production means applied to manufacture the tile. In an embodiment inclination of the downward aligned edge is less than the inclination of at least an upper part of the upward flank, as result of which an expansion chamber will be formed between both surface which will be favourable to allow play and to compensate expansion, e.g. due to moist absorption by the tiles.

In a variant at least a part of an upper side of the upward tongue extends in a direction toward the normal of the upper side of the base layer. This has the result that the thickness of the upward tongue decreases in the direction of the side of the tongue facing away from the upward flank. By having the downward groove substantially connect to the upper side of the upward tongue, in a coupled position of two tiles according to the invention wherein an upper side of the downward groove extends in the direction of the normal of the lower side of the base layer, a second coupling part can be provided which is on the one hand relatively strong and solid and can on the other guarantee sufficient resilience to enable a coupling to be realized to a first coupling part of an adjacent tile.

The aligning edges are preferably formed by a flat surface so as to allow guiding of another coupling part during the process of coupling two tiles to proceed be generally in as controlled a manner as possible. Application of a rounded aligning edge is, however, also imaginable. In another embodiment variant at least a part of the aligning edge of the second coupling part has a substantially flatter orientation than at least a part of the upward flank of the first coupling part. By applying this measure there is generally created in a coupled position an air gap between the aligning edge of the second coupling part and a flank of the first coupling part. This clearance intentionally created between the two coupling parts is usually advantageous during coupling of adjacent tiles, since this clearance does not prevent a temporary deformation of the coupling parts, this facilitating coupling of the coupling parts. Furthermore, the created clearance is advantageous for the purpose of absorbing expansion of the tile, for instance resulting from environmental temperature changes.

In an embodiment variant a part of the upward flank of the first coupling part connecting to the base layer forms a stop surface for at least a part of the side of the downward tongue facing away from the downward flank. In this way a close fitting of at least the upper side of the tiles can be realized, this usually being advantageous from a user viewpoint. A part of the upward flank of the first coupling part connecting to the base layer is here preferably oriented substantially vertically. At least a part of the side of the downward tongue facing away from the downward flank is here also preferably oriented substantially vertically. Applying substantially vertical stop surfaces in both coupling parts has the advantage that in the coupled position the coupling parts can connect to each other in relatively close-fitting and firm manner.

It is generally advantageous for the upward groove to be adapted to receive with clamping fit a downward tongue of an adjacent tile. Receiving the upward groove, or at least a part thereof, with clamping fit in the downward tongue has the advantage that the downward tongue is enclosed relatively close-fittingly by the upward groove, this usually enhancing the firmness of the coupled construction. The same applies for the embodiment variant in which the downward groove is adapted to receive with clamping fit an upward tongue of an adjacent tile.

In an embodiment variant the upward flank and the downward flank extend in a substantially parallel direction. This makes it possible to connect the flanks, as well as the locking elements, relatively closely to each other in a coupled position, this generally enhancing the locking effect realized by the locking elements.

In another embodiment variant the first locking element, if applied, includes at least one outward bulge, and the second locking element, if applied, includes at least one recess, which outward bulge is adapted to be at least partially received in a recess of an adjacent coupled tile for the purpose of realizing a locked coupling. This embodiment variant is generally advantageous from a production engineering viewpoint. The first locking element and the second locking element preferably take a complementary form, whereby a form-fitting connection of the locking elements of adjacent tiles to each other will be realized, this enhancing the effectiveness of the locking. Alternatively, the second locking element includes at least one outward bulge, and the first locking element includes at least one recess, which outward bulge is adapted to be at least partially received in a recess of an adjacent coupled tile for the purpose of realizing a locked coupling. It is also conceivable that the first and second locking elements are not formed by a bulge-recess combination, but by another combination of co-acting profiled surfaces and/or high-friction contact surfaces. In this latter embodiment, the first locking element and/or the second locking element may be formed by a (flat of otherwise shaped) contact surface composed of a, optionally separate, plastic material configured to generate friction with the other locking element of another tile in engaged (coupled) condition. Examples of plastics suitable to generate friction include:

- Acetal (POM), being rigid and strong with good creep resistance. It has a low coefficient of friction, remains stable at high temperatures, and offers good resistance to hot water;
- Nylon (PA), which absorbs more moisture than most polymers, wherein the impact strength and general energy absorbing qualities actually improve as it absorbs moisture. Nylons also have a low coefficient of friction, good electrical properties, and good chemical resistance;
- Polyphthalamide (PPA). This high performance nylon has through improved temperature resistance and lower moisture absorption. It also has good chemical resistance;
- Polyetheretherketone (PEEK), being a high temperature thermoplastic with good chemical and flame resistance combined with high strength. PEEK is a favorite in the aerospace industry;
- Polyphenylene sulphide (PPS), offering a balance of properties including chemical and high-temperature resistance, flame retardance, flowability, dimensional stability, and good electrical properties;
- Polybutylene terephthalate (PBT), which is dimensionally stable and has high heat and chemical resistance with good electrical properties;
- Thermoplastic polyimide (TPI) being inherently flame retardant with good physical, chemical, and wear-resistance properties.
- Polycarbonate (PC), having good impact strength, high heat resistance, and good dimensional stability. PC also has good electrical properties and is stable in water and mineral or organic acids; and
- Polyetherimide (PEI), maintaining strength and rigidity at elevated temperatures. It also has good long-term heat resistance, dimensional stability, inherent flame retardance, and resistance to hydrocarbons, alcohols, and halogenated solvents.

The performance of many of the above polymers can also be enhanced using certain additives which reduce fiction (if desired). The high-friction polymer material may, for example, be applied as a (separate) material strip. Application of this high-friction polymer material allows the distant side (outer side) of the upward tongue and the downward flank to have a substantially flat design.

In an embodiment of the tile according to the invention the first locking element is positioned at a distance from an upper side of the upward tongue. Positioning the first locking element at a distance from the upper side of the upward tongue has a number of advantages. A first advantage is that this positioning of the first locking element can facilitate the coupling between adjacent tiles, since the first locking element will be positioned lower than (a lower part of) the aligning edge of the upward tongue, whereby the coupling between two coupling parts can be performed in stages. During the coupling process the tongue sides facing toward the associated flanks will first engage each other, after which the locking elements engage each other, this generally requiring a less great maximum pivoting (amplitude), and thereby deformation of a second coupling part of an adjacent tile, than if the first aligning edge and the first locking element were to be located at more or less the same height. A further advantage of positioning the first locking element at a distance from an upper side of the upward tongue is that the distance to the resilient connection between each coupling part and the base layer, generally formed by the resilient bridge of each coupling part, is increased, whereby a torque exerted on the coupling parts can be compensated relatively quickly by the locking elements, which can further enhance the reliability of the locking. In case the first locking element and second locking element would not be applied, it may be favourable that side of the upward tongue facing away from the upward flank is positioned at a distance from the downward flank in coupled condition of adjacent tiles.

In a preferred embodiment, a side of the downward tongue facing away from the downward flank is provided with a third locking element, and wherein the upward flank is provided with a fourth locking element, said third locking element being adapted to cooperate with a fourth locking element of another tile. This would result in an additional inner locking mechanism, which could further improve the stability and reliability of the coupling. Also in this embodiment, the third (or fourth) locking element may be formed by one or more bulges, wherein the fourth (or third) locking element may be formed by one of more complementary recesses adapted to co-act with said bulges in coupled condition of adjacent tiles. Preferably, the co-action between the third locking element and the fourth locking element, in coupled condition of two tiles, defines a tangent T1 which encloses an angle A1 with a plane defined by the tile, which angle A1 is smaller than an angle A2 enclosed by said plane defined by the tile and a tangent T2 defined by a co-action between an inclined part of a side of the upward tongue facing toward the upward flank and an inclined part of a side of the downward tongue facing toward the downward flank. More preferably, the greatest difference between angle A1 and angle A2 is situated between 5 and 10 degrees. It is imaginable that shortest distance between an upper edge of the downward tongue and a lower side of the base layer defines a plane, wherein the third locking element and at least a part of the downward tongue are situated at opposite sides of said plane. In this case, the third locking element protrudes with respect to the tile edge defined by an upper section or upper surface of the tile. Here, the third locking element may protrude into an adjacent tile in a coupled condition which may further improve the tile coupling. It is advantageous in case the minimum distance between said locking surface and an upper side of the tile is smaller than the minimum distance between an upper side of the upward tongue and said upper side of the tile. This will reduce the maximum deformation of the second (or first) coupling part, whereas the connection process and deformation process can be executed in successive steps. Less deformation leads to less material stress which is in favour of the life span of the coupling part(s) and hence of the tile(s).

The ordinal numbers used in this document, like "first", "second", "third", and "fourth" are used only for identification purposes. The use of the expressions "third locking element" and "fourth locking element" does therefore not necessarily require the co-presence of a "first locking element" and a "second locking element".

The invention also relates to a tile covering, in particular floor covering, wall covering, ceiling covering and/or furniture covering, consisting of mutually coupled tiles according to the invention. The invention also relates to a tile for use in multi-purpose tile system according to the invention.

Preferred embodiments of the invention are set out in the following non-limitative clauses:

CLAUSES

1. Multi-purpose tile system, in particular a floor tile system, including a plurality of multi-purpose tiles, in particular floor tiles, wherein said tiles are configured to being joined in a chevron pattern, wherein each tile includes:

a first pair of opposing edges consisting of a first edge and an opposite second edge;

a second pair of opposing edges consisting of a third edge and an opposing fourth edge, wherein:

the first edge and the third edge enclose a first acute angle, and wherein the second edge and the fourth edge enclose a second acute angle opposing said first acute angle, and wherein the second edge and the third edge enclose a first obtuse angle, and wherein the first edge and the fourth edge enclose a second obtuse angle opposing said first obtuse angle, and wherein the first pair of opposing edges have pairs of opposing first mechanical coupling means for locking together said tiles at least vertically, and preferably also horizontally, including:

a first coupling profile including a sideward tongue extending in a direction substantially parallel to the upper side of the tile, and an opposing second coupling profile including a recess configured for accommodating at least a part of the sideward tongue of a further tile, said recess being defined by an upper lip and a lower lip, wherein said first mechanical coupling profiles allow locking together said tiles by inward angling whereby at least a part of the sideward tongue is received by the recess, and wherein the second pair of opposing edges have pairs of opposing second mechanical coupling means for locking together said tiles vertically and horizontally, including:

a third coupling profile, including an upward tongue, at least one upward flank lying at a distance from the upward tongue and an upward groove formed between the upward tongue and the upward flank, wherein at least a part of a side of the upward tongue facing the upward flank is inclined toward the upward flank, and wherein at least a part of a side of the upward tongue facing away from the upward flank optionally includes at least one first locking element, which preferably makes integral part of the upward tongue, and a fourth coupling profile, including a downward tongue, at least one downward flank lying at a distance from the downward tongue, and a downward groove formed between the downward tongue and the downward flank, wherein at least a part of a side of the downward tongue facing the downward flank is inclined toward the downward flank, and wherein the downward flank optionally includes at least one second locking element, which preferably makes integral part of the downward flank, and adapted for co-action with the at least one first locking element of yet a further tile, wherein the second mechanical coupling profiles allow locking together said tiles during inward angling of the first coupling profile of a tile and the second coupling profile of another tile, wherein the fourth coupling profile of the tile to be coupled makes a scissoring movement toward the third coupling profile of yet another tile, leading to locking of the third coupling profile and the fourth coupling profile, wherein each tile includes a substantially rigid base layer at least partially made of a foamed composite including at least one plastic material and at least one filler.

2. Tile system according to clause 1, wherein the system includes two different types of tiles (A and B respectively), and wherein the first mechanical coupling means of one type of tile along the first pair of opposite edges are arranged in a mirror-inverted manner relative to the corresponding first mechanical coupling means along the same first pair of opposite edge portions of the other type of tile.

3. Tile system according to clause 1 or 2, wherein at least one tile has a configuration wherein:

the first coupling profile is arranged at the first edge;

the second coupling profile is arranged at the second edge;

the third coupling profile is arranged at the third edge; and the fourth coupling profile is arranged at the fourth edge.

4. Tile system according to one of the foregoing clauses, wherein at least one tile has a configuration wherein:

the first coupling profile is arranged at the second edge;

the second coupling profile is arranged at the first edge;

the third coupling profile is arranged at the third edge; and the fourth coupling profile is arranged at the fourth edge.

5. Tile system according to one of the foregoing clauses, wherein:

the first coupling profile includes a sideward tongue extending in a direction substantially parallel to the upper side of the tile, the bottom front region of said sideward tongue, the bottom back region of said tongue being configured as bearing region, wherein the bottom back region is located closer to the level of the upper side of the tile than a lowest part of the bottom front region, and wherein the second coupling profile includes a recess for accommodating at least a part of the sideward tongue of a further tile, said recess being defined by an upper lip and a lower lip, said lower lip being provided with a upwardly protruding shoulder for supporting and/or facing the bearing region of the sideward tongue, wherein the sideward tongue being designed such that locking takes place by an introduction movement into the recess of the sideward tongue a further tile and a angling down movement about an axis parallel to the first coupling profile, as a result of which a top side of the sideward tongue will engage the upper lip and the bearing region of the sideward tongue will be supported by and/or will be facing the shoulder of the lower lip, leading to locking of adjacent tiles at the first and second edges in both horizontal direction and vertical direction.

6. Tile system according to one of the foregoing clauses, wherein:

the third coupling profile includes an upward tongue, at least one upward flank lying at a distance from the upward tongue and an upward groove formed between the upward tongue and the upward flank, wherein at least a part of a side of the upward tongue facing the upward flank is inclined toward the upward flank, and wherein at least a part of a side of the upward tongue facing away from the upward flank optionally includes at least one first locking element, which preferably makes integral part of the upward tongue, and wherein the fourth coupling profile includes a downward tongue, at least one downward flank lying at a distance from the downward tongue, and a downward groove formed between the downward tongue and the downward flank, wherein at least a part of a side of the downward tongue facing the downward flank is inclined toward the downward flank, and wherein the downward flank optionally includes at least one second locking element, which preferably makes integral part of the downward flank, and adapted for co-action with the at least one first locking element of the third coupling profile of yet a further tile, the third and fourth coupling profiles being designed such that locking takes place during angling down of a tile to be coupled at the first coupling profile to the second coupling profile of a further tile, wherein the fourth coupling profile of the tile to be coupled makes a scissoring movement toward a third coupling profile of yet another tile, such that the downward tongue of the fourth coupling profile of the tile to be coupled will be forced into the upward groove of the third coupling profile of said other tile and the upward tongue of said other tile will be forced into the downward groove of the tile the be coupled, by deformation of the third coupling profile and/or the coupling profile edge, leading to locking of adjacent tiles at the third and fourth coupling profiles in both horizontal direction and vertical direction.

7. Tile system according to one of the foregoing clauses, wherein the length of the first edge and the length of the second edge of a tile are substantially identical.

8. Tile system according to one of the foregoing clauses, wherein the length of the first edge and the length of the second edge of a tile are greater than the length of the third edge and the fourth edge of said tile.

9. Tile system according to one of the foregoing clauses, wherein the first acute angle and the second acute angle are situated between 30 and 60 degrees, and are preferably substantially 45 degrees.

10. Tile system according to one of the foregoing clauses, wherein the first obtuse angle and the second obtuse angle are situated between 120 and 150 degrees, and are preferably substantially 135 degrees.

11. Tile system according to one of the foregoing clauses, wherein at least one tile includes at least one upper substrate affixed to an upper side the base layer, wherein said upper substrate preferably includes a decorative layer.

12. Tile system according to clause 11, wherein the at least one upper substrate includes:

a decorative layer and an abrasion resistant wear layer covering said decorative layer, wherein a top surface of said wear layer is the top surface of said tile, and wherein the wear layer is a transparent material, such that decorative layer is visible through the transparent wear layer, and, optionally, a transparent finishing layer situated in between the decorative layer and the wear layer.

13. Tile system according to one of the foregoing claims, wherein the at least one upper substrate includes a back layer, preferably a thermoplastic back layer, situated in between the base layer and the decorative layer.

14. Tile system according to one of clauses 11-13, wherein the upper substrate is at least partially made of at least one material selected from the group consisting of: metals, alloys, macromolecular materials such as vinyl monomer copolymers and/or homopolymers; condensation polymers such as polyesters, polyamides, polyimides, epoxy resins, phenol-formaldehyde resins, urea formaldehyde resins; natural macromolecular materials or modified derivatives thereof such as plant fibres, animal fibres, mineral fibres, ceramic fibres and carbon fibres.

15. Tile system according to in clause 14, wherein the vinyl monomer copolymers and/or homo-polymers are selected from the group consisting of polyethylene, polyvinyl chloride, polystyrene, polymethacrylates, polyacrylates, polyacrylamides, ABS, (acrylonitrile-butadiene-styrene) copolymers, polypropylene, ethylene-propylene copolymers, polyvinylidene chloride, polytetrafluoroethylene, polyvinylidene fluoride, hexafluoropropene, and styrene-maleic anhydride copolymers.

16. Tile system according to one of clauses 11-15, wherein the at least one upper substrate is affixed to the upper side of the base layer by means of an adhesive.

17. Tile system according to one of clauses 11-16, wherein at least one tile includes a plurality of strip shaped upper substrates affixed to an upper side the base layer, wherein said upper substrate are arranged side by side in the same plane, preferably in a parallel configuration.

18. Tile system according to clause 17, wherein the plurality of upper substrates substantially completely cover the upper surface of the base layer.

19. Tile system according to clause 17 or 18, wherein each of the plurality of upper substrates extends from the first edge to the second edge of the tile.

20. Tile system according to one of clauses 17-19, wherein each of the plurality of upper substrates includes a decorative layer, wherein the decorative layers of at least two adjacently arranged upper substrates have different appearances.

21. Tile system according to one of clauses 17-20, wherein each strip shaped upper substrate includes a back layer situated in between the base layer and the decorative layer.

22. Tile system according to clause 21, wherein the width of a top portion of the back layer is larger than the width of a bottom portion of the back layer.

23. Tile system according to clause 21 or 22, wherein opposing longitudinal edges of at least one strip shaped upper substrate are inclined inwardly, as seen in downward direction.

24. Tile system according to one of clauses 17-23, wherein facing longitudinal edges of at least two strip shaped upper substrates are provided, near the top side, with a bevel.

25. Tile system according to clause 24, wherein each bevel is formed by a cut-away portion and/or imprinted portion of a wear layer covering the decorative layer.

26. Tile system according to one of the foregoing claims, wherein each strip shaped upper substrate includes a substantially transparent or translucent three-dimensional embossing structure at least partially covering said print layer.

27. Tile system according to one of the foregoing clauses, wherein the weight percentage of plastic material in the base layer is situated between 40% and 45%.

28. Tile system according to one of the foregoing clauses, wherein at least one filler is calcium carbonate, wherein the weight percentage of calcium carbonate in the base layer is between 45% and 48%.

29. Tile system according to one of the foregoing clauses, wherein the base layer includes a foaming agent.

30. Tile system according to clause 29, wherein the base layer includes at least two different foaming agents configured to decompose at different decomposition temperatures.

31. Tile system according to clause 29 or 30, wherein the base layer includes at least one activated foaming agent, preferably a plurality of activated foaming agents, more preferably at least two different activated foaming agents configured to decompose at different decomposition temperatures.

32. Tile system according to one of clauses 29-31, wherein the base layer includes at least one endothermic foaming agent, preferably sodium bicarbonate, and at least one exothermic foaming agent, preferably azodicarbonamide (ACDA).

33. Tile system according to one of the foregoing clauses, wherein the plastic material of the foamed composite of the base layer is poly vinyl chloride (PVC).

34. Tile system according to one of the foregoing clauses, wherein the plastic material of the foamed composite of the base layer is at least one material selected from the group consisting of: ethylene vinyl acetate (EVA), polyurethane (PU), polyethylene (PE), polypropylene (PP), polystyrene (PS), poly vinyl chloride (PVC), or mixtures thereof.

35. Tile system according to one of the foregoing clauses, wherein at least one filler of the base layer is selected from the group consisting of: talc, chalk, wood, calcium carbonate, and a mineral filler.

36. Tile system according to one of the foregoing clauses, wherein at least one filler of the base layer is selected from the group consisting of: a salt, a stearate salt, calcium stearate, and zinc stearate.

37. Tile system according to one of the foregoing clauses, wherein the base layer includes at least one impact modifier including at least one alkyl methacrylates, wherein said alkyl methacrylate is preferably chosen from the group consisting of: methyl methacrylate, ethyl methacrylate, propyl methacrylate, isopropyl methacrylate, t-butyl methacrylate and isobutyl methacrylate.

38. Tile system according to one of the foregoing clauses, wherein the substantially rigid base layer is at least partially made of a closed cell foam plastic material, which plastic material is free of plasticizer.

39. Tile system according to any of the foregoing clauses, wherein the foamed composite has a density in the range of about 0.1 to 1.5 g/cm3.

40. Tile system according to one of the foregoing clauses, wherein the foamed composite contains approximately 3% to 9% by weight of the toughening agent.

41. Tile system according to one of the foregoing clauses, wherein the foamed composite has an elastic modulus of more than 700 MPa.

42. Tile system according to one of the foregoing clauses, wherein the density of the base layer varies along the height of the base layer.

43. Tile system according to one of the foregoing clauses, wherein a top section and/or a bottom section of the base layer forms a crust layer having a porosity which is less than the porosity of a centre region of the base layer, wherein the thickness of each crust layer is between 0.01 and 1 mm, preferably between 0.1 and 0.8 mm.

44. Tile system according to one of the foregoing clauses, wherein each tile includes at least one backing layer affixed to a bottom side of the base layer, wherein said at least one backing layer at least partially made of a flexible material, preferably an elastomer.

45. Tile system according to clause 42, wherein the thickness of the backing layer is at least 0.5 mm.

46. Tile system according to one of the foregoing clauses, wherein each tile includes at least one reinforcing layer, wherein the density of the reinforcing layer is preferably situated between 1000 and 2000 kg/m3, preferably between 1400- and 1900 kg/m3, and more preferably between 1400-1700 kg/m3.

47. Tile system according to one of the foregoing clauses, wherein at least a part of the first coupling part and/or at least a part of second coupling part of each tile is integrally connected to the base layer.

48. Tile system according to one of the foregoing clauses, wherein the first coupling part and/or the second coupling part allows deformation during coupling and uncoupling.

49. Tile system according to any of the foregoing clauses, wherein at least one coupling part of the first coupling part and second coupling part includes a bridge connecting the tongue of said coupling element to the base layer, wherein the minimum thickness of the bridge is smaller than the minimum width of the tongue.

50. Tile system according to any of the foregoing clauses, wherein the second coupling part includes an upper bridge connecting the downward tongue to the base layer, wherein the upper bridge is configured to deform during coupling of adjacent tiles, to widen the downward groove, and wherein, preferably, a lower side of the upper bridge of the second coupling part is at least partially inclined.

51. Tile system according to clause 50, wherein the upper side of the upward tongue is at least partially inclined, wherein the inclination of the upper side of the upward tongue and the inclination of the bridge part of the second coupling part are substantially similar, wherein both inclinations for instance mutually enclose an angle between 0 and 5 degrees.

52. Tile system according to any of the foregoing clauses, wherein at least a part of the upward flank adjoining the upper side of the tile is adapted to make contact with at least a part of the downward tongue adjoining the upper side of another tile in a coupled state of these tiles.

53. Tile system according to clause 52, wherein the upper side of the tile is adapted to engage substantially seamless to the upper side of another tile.

54. Tile system according to any of the foregoing clauses, wherein the first locking element is positioned at a distance from an upper side of the upward tongue.

55. Tile system according to any of the foregoing clauses, wherein the second locking element is positioned at a distance from an upper side of the downward groove.

56. Tile system according to any of the foregoing clauses, wherein the effective height of the downward aligned edge is larger than the effective height of the upward tongue.

57. Tile system according to any of the foregoing clauses, wherein the mutual angle enclosed by at least an inclined part of a side of the upward tongue facing toward the upward flank and the upward flank is substantially equal to the mutual angle enclosed by at least an inclined part of a side of the downward tongue facing toward the downward flank and the downward flank.

58. Tile system according to any of the foregoing clauses, wherein the angle enclosed by on the one hand the direction in which at least a part of a side of the upward tongue facing toward the upward flank extends and on the other the normal of the upper side of the base layer lies between 0 and 60 degrees, in particular between 0 and 45 degrees.

59. Tile system according to any of the foregoing clauses, wherein the angle enclosed by on the one hand the direction in which at least a part of a side of the downward tongue facing toward the downward flank extends and on the other the normal of the lower side of the base layer lies between 0 and 60 degrees, in particular between 0 and 45 degrees.

60. Tile system according to any of the foregoing clauses, wherein the first locking element includes at least one outward bulge, and that the second locking element includes at least one recess, which outward bulge is adapted to be at least partially received in a recess of an adjacent coupled tile for the purpose of realizing a locked coupling.

61. Tile system according to any of the foregoing clauses, wherein the first locking element is positioned at a distance from an upper side of the upward tongue.

62. Tile system according to any of the foregoing clauses, wherein a side of the downward tongue facing away from the downward flank is provided with a third locking element, and wherein the upward flank is provided with a fourth locking element, said third locking element being adapted to cooperate with a fourth locking element of another tile.

63. Tile system according to clause 62, wherein the co-action between the third locking element and the fourth locking element, in coupled condition of two tiles, defines a tangent T1 which encloses an angle A1 with a plane defined by the tile, which angle A1 is smaller than an angle A2 enclosed by said plane defined by the tile and a tangent T2 defined by a co-action between an inclined part of a side of the upward tongue facing toward the upward flank and an inclined part of a side of the downward tongue facing toward the downward flank.

64. Tile system according to clause 63, wherein the greatest difference between angle A1 and angle A2 is situated between 5 and 10 degrees.

65. Tile system according to one of clauses 62-64, wherein the shortest distance between an upper edge of the downward tongue and a lower side of the base layer defines a plane, wherein the third locking element and at least a part of the downward tongue are situated at opposite sides of said plane.

66. Tile system according to one of clauses 62-65, wherein the minimum distance between said third locking element and an upper side of the tile is smaller than the minimum distance between an upper side of the upward tongue and said upper side of the tile.

67. Tile system according to any of the foregoing clauses, wherein a side of the upward tongue facing away from the upward flank is positioned at a distance from the downward flank, in coupled condition of adjacent tiles.

68. Tile system according to any of the foregoing clauses, wherein at least a number of tiles is identical.

69. Tile system according to any of the foregoing clauses, wherein the tile system includes different types of tiles (A and B respectively), wherein the size of a first type of tile (A) differs from the size of second type of tile (B).

70. Tile system according to one of the foregoing clauses, wherein distinctive visual markings are applied to different tile types, preferably for installation purposes.

71. Tile system according to clause 70, wherein distinctive visual markings are applied to the upward tongue of at least one first coupling element of each tile type.

72. Tile system according to one of the foregoing clauses, wherein at least one pair of opposing edges of a tile, preferably each tile, are provided, near the top side, with a bevel.

73. Tile system according to one of the foregoing clauses, wherein the decorative layer is formed by an ink layer digitally printed onto a supporting layer, such as the base layer or a primer layer applied onto the base layer.

74. Tile system according to one of the foregoing clauses, wherein the decorative layer is formed by a printed synthetic film.

75. Tile covering, in particular floor covering, ceiling covering, or wall covering, consisting of mutually coupled tiles according to any of the clauses 1-74.

76. Tile for use in multi-purpose tile system according to one of clauses 1-74.

BRIEF DESCRIPTION OF THE DRAWINGS

The invention will be elucidated on the basis of non-limitative exemplary embodiments shown in the following figures. Herein shows.

DETAILED DESCRIPTION OF THE PREFERRED EMBODIMENTS

Figure 1:
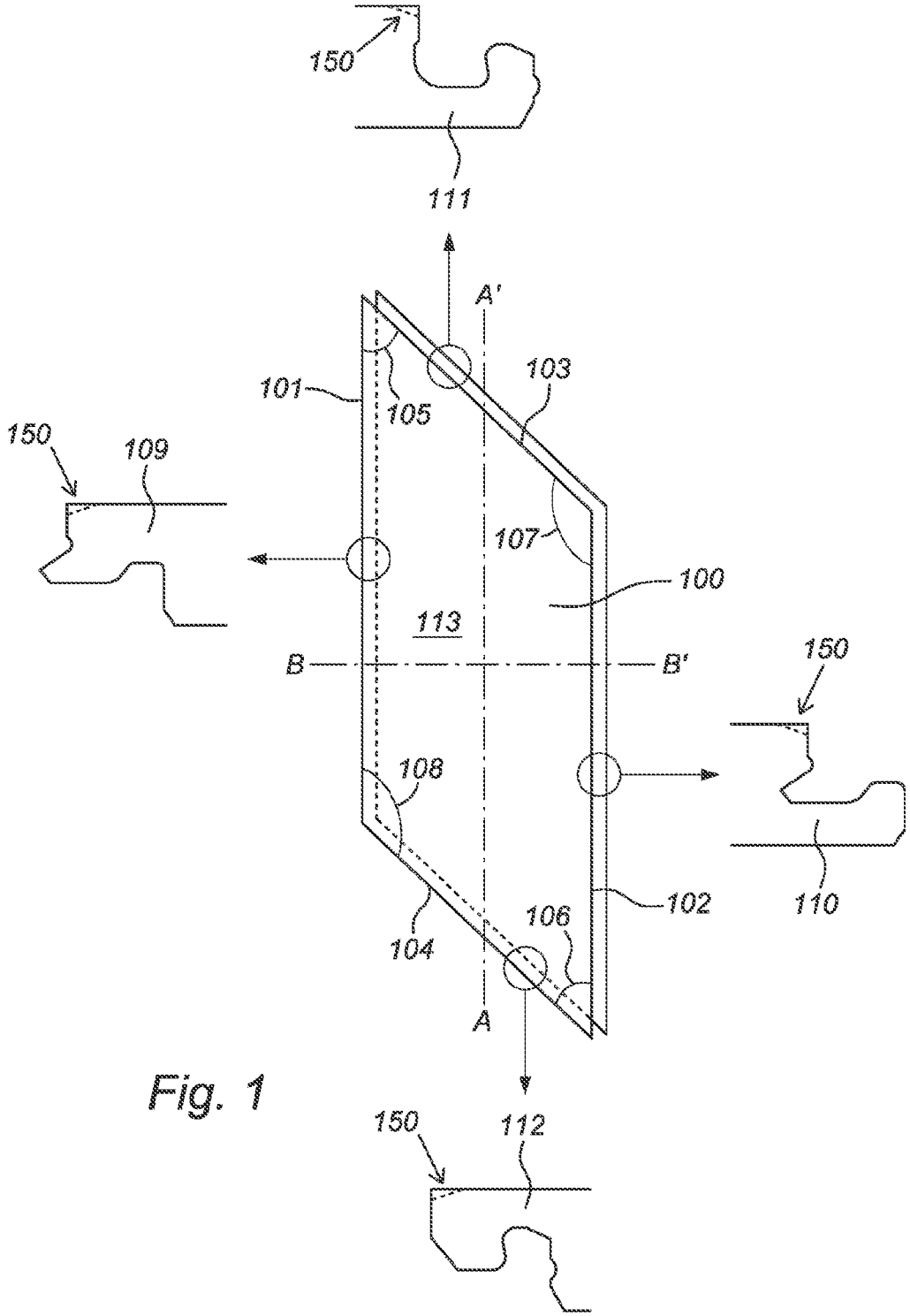
FIG. 1 a schematic representation of a tile for use in multi-purpose tile system according to the invention.

FIG. 1 shows a schematic representation of the general configuration of a tile 101 for use in multi-purpose tile system according to the invention. The figure shows a tile 100 including a first pair of opposing edges consisting of a first edge 101 and an opposite second edge 102 and a second pair of opposing edges consisting of a third edge 103 and an opposing fourth edge 104. The first edge 101 and the third edge 103 enclose a first acute angle 105 and the second edge 102 and the fourth edge 104) enclose a second acute angle 106 opposing said first acute angle 105. The second edge 102 and the third edge 103 enclose a first obtuse angle 107, and the first edge 101 and the fourth edge 104 enclose a second obtuse angle 108 opposing said first obtuse angle 107. Both the first pair of opposing edges 101, 102 and the second pair of opposing edges 103, 104 include opposing mechanical coupling means for locking purposes. FIG. 1 shows in an indicative way how the configuration of mechanical coupling means of the tile 100 can be performed. The first edge 101 includes a first coupling profile 109 and the second edge includes 102 includes a second coupling profile 110. The first coupling profile 109 and the second coupling profile 110 will be elucidated in more detail in FIGS. 3*a* and 3*b*. The third edge 103 includes a third coupling profile 111 and the fourth edge 104 includes a fourth coupling profile 112. The third coupling profile 111 and the fourth coupling profile 112 will be elucidated in more detail in FIGS. 2*a* and 2*b*, and alternatives thereof in FIGS. 2*c* and 2*d*. The tile 100 includes a substantially rigid base layer 113 which is at least partially made of a foamed composite including at least one a closed cell foam plastic material and at least one filler. Cross-sections of lines A-A' and B-B' and alternatives thereof are schematically shown in FIGS. 2*a*-3*g*. The tile 100 has the shape of a parallelogram, such that multiple tiles 100 can form a chevron pattern in a joined state. Optionally, the first pair of opposing edges 101, 102 and/or the second pair of opposing edges 103, 104 may be provided with a bevel near the top surface. In the figures discussed below, likewise one or more bevels may be applied. Additionally, the tile 101 may include a plurality of strip shaped upper substrates affixed to the upper side of a base layer (core layer) of the tile, as for example shown in FIGS. 5, 6*a*, and 6*b*. Here, longitudinal edges of at least two strip shaped upper substrates are preferably provided, near the top surface, with bevels.

Figure 2A:
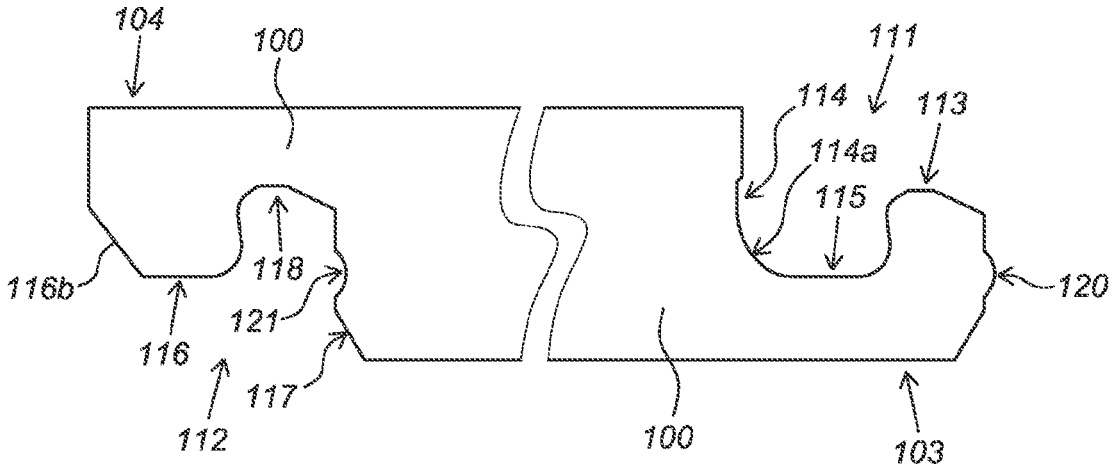
FIG. 2*a* a first cross section of the tile shown in FIG. 1.
Figure 2B:
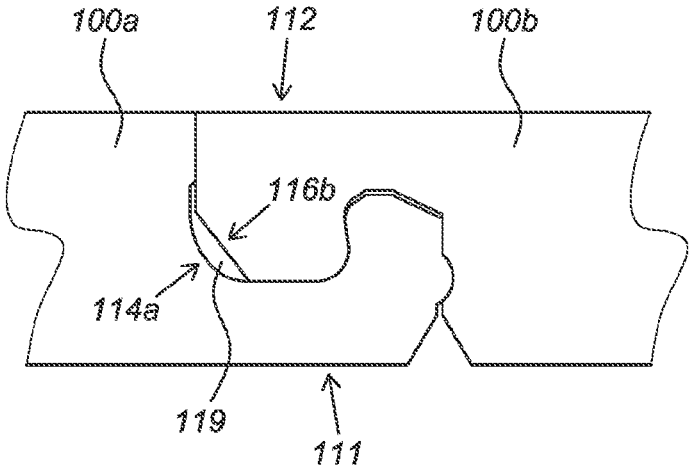
FIG. 2*b* a coupled position of two tiles including coupling profiles as shown in FIG. 2*a;*

FIG. 2*a* shows a schematic representation of a cross-sections of line A-A' of the tile 100 shown in FIG. 1. The figure shows the third edge 103 including a third coupling profile 111 and the fourth edge 104 including a fourth coupling profile 112. FIG. 2*b* shows a schematic representation of the coupled position of two tiles 100*a*, 100*b* including coupling profiles 111, 112 as shown in FIG. 2*a*. The third coupling profile includes an upward tongue 113, an upward flank 114 lying at a distance from the upward tongue 113 and an upward groove 115 formed between the upward tongue 113 and the upward flank 114. The fourth coupling profile 112 includes a downward tongue 116, a downward flank 117 lying at a distance from the downward tongue 116, and a downward groove 118 formed between the downward tongue 116 and the downward flank 117. A side 116*b* facing away from the downward flank 117 is diagonally oriented. The side 116*b* has a substantially straight design, where the complementary side 114*a* of the upward flank 114 has a rounded design. An air gap 119 is formed in the coupled position shown in FIG. 2*b*. The third coupling profile 111 includes a first locking element 120 which is adapted for co-action with a second locking element 121 which is provided in the flank 117 of the fourth coupling profile 112. The first locking element 120 includes an outward bulge, and the second locking element 121 includes a recess, which outward bulge is adapted to be at least partially received in a recess of an adjacent coupled tile for the purpose of realizing a locked coupling. FIG. 2*b* shows a tile 100*b* being coupled with an adjacent tile 100*a*, leading to locking of the third coupling profile 111 and the fourth coupling profile 112. The tongues 113, 116, flanks 114, 117 and grooves 115, 118 of the embodiments shown in FIGS. 2*a*-*b* have a substantially rounded design. However, it is also possible that the tongues 113, 116, flanks 114, 117 and/or grooves 115, 118 have a more rectilinear design.

Figure 2C:
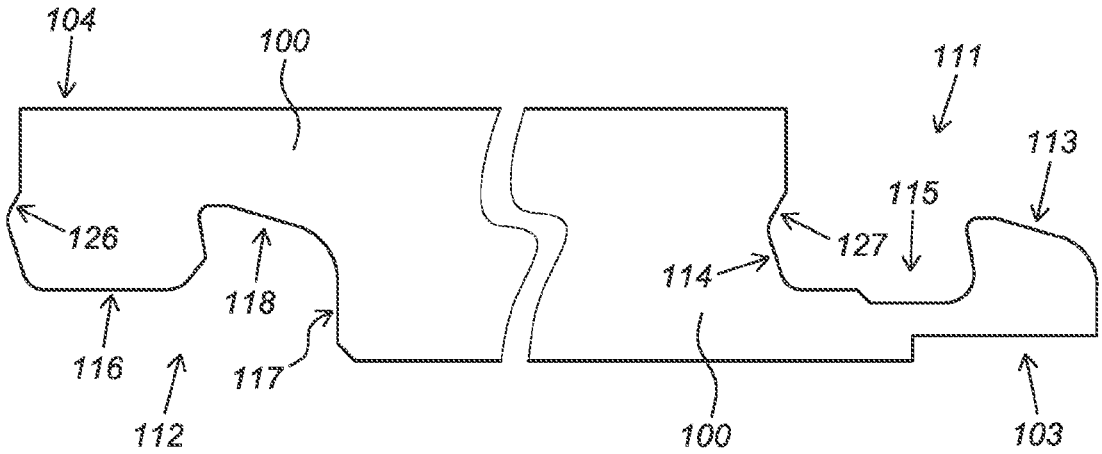
FIG. 2*c* an alternative configuration of the tile shown in FIG. 2*a;*
Figure 2D:
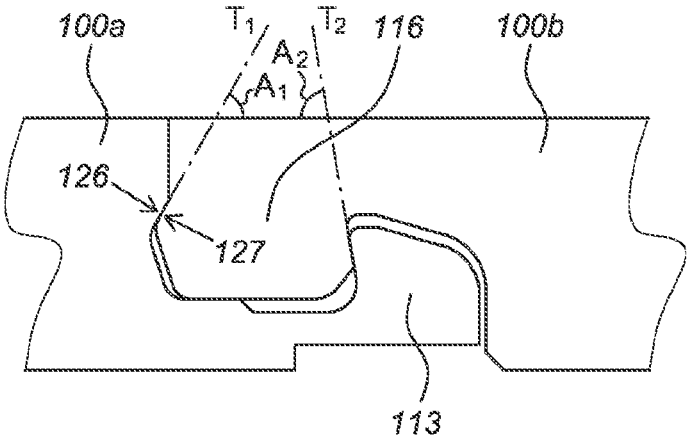
FIG. 2*d* a coupled position of two tiles including coupling profiles as shown in FIG. 2*c;*

FIG. 2*c* shows a schematic representation of an alternative configuration of the tile 100 equivalent to the tile 100 shown in FIGS. 2*a* and 2*b*, wherein the figure shows a possible cross-section of line A-A' of the tile 100 shown in FIG. 1. Similar reference numbers show similar or equivalent technical features. The third edge 103 includes a third coupling profile 111 and the fourth edge 104 includes a fourth coupling profile 112. FIG. 2*d* shows a schematic representation of the coupled position of two tiles 100*a*, 100*b* including coupling profiles 111, 112 as shown in FIG. 2*c*. The third coupling profile includes an upward tongue 113, an upward flank 114 lying at a distance from the upward tongue 113 and an upward groove 115 formed between the upward tongue 113 and the upward flank 114. The fourth coupling profile 112 includes a downward tongue 116, a downward flank 117 lying at a distance from the downward tongue 116, and a downward groove 118 formed between the downward tongue 116 and the downward flank 117. In the shown embodiment a side of the downward tongue 116 facing away from the downward flank 117 is provided with a third locking element 126, and the upward flank 114 is provided with a fourth locking element 127, said third locking element 126 being adapted to cooperate with a fourth locking element 127 of another tile 100. This would result in an additional inner locking mechanism, which could further improve the stability and reliability of the coupling. The co-action between the third locking element 126 and the fourth locking element 127, in coupled condition of two tiles, defines a tangent T1 which encloses an angle A1 with a plane defined by the tile, which angle A1 is smaller than an angle A2 enclosed by said plane defined by the tile and a tangent T2 defined by a co-action between an inclined part of a side of the upward tongue 113 facing toward the upward flank 114 and an inclined part of a side of the downward tongue 116 facing toward the downward flank 117. In general, the greatest difference between angle A1 and angle A2 is situated between 5 and 10 degrees.

Figure 3A:
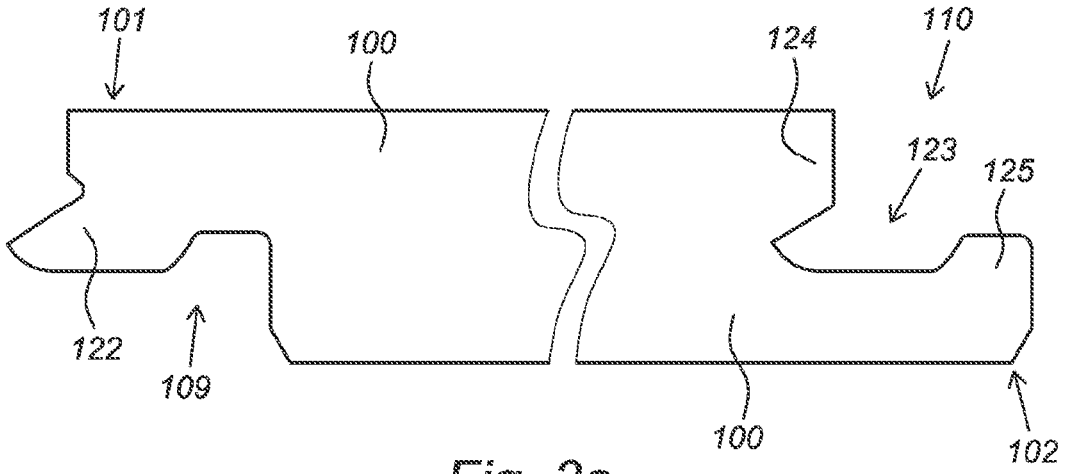
FIG. 3*a* a second cross-section of the tile as shown in FIG. 1.
Figure 3B:
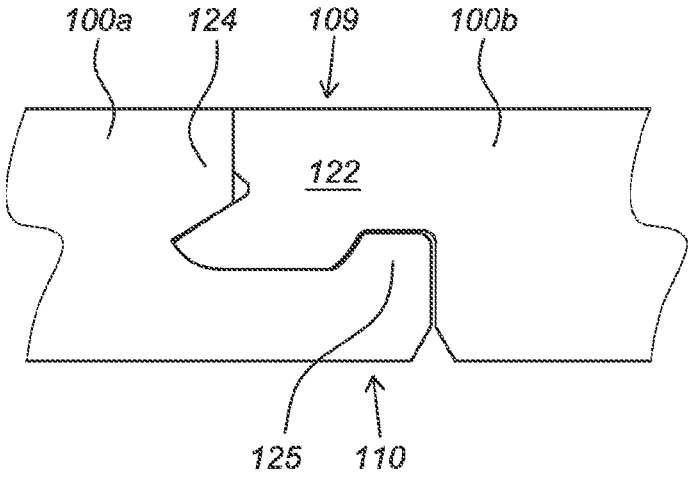
FIG. 3*b* a coupled position of two tiles as shown in FIG. 3*a;*

FIG. 3*a* shows a schematic representation of a second cross-section of the tile 100 shown in FIG. 1. The figure shown in particular a cross-section of line B-B'. The figure shows the first edge 101 including a first coupling profile 109 and the second edge 102 including a second coupling profile 110. FIG. 3*b* shows a schematic representation of the coupled position of two tiles 100*a*, 100*b* including coupling profiles 109, 110 as shown in FIG. 3*a*. The first coupling profile 109 includes a sideward tongue 122 extending in a direction substantially parallel to the upper side of the tile 100. The second coupling profile 110 includes a recess 123 configured for accommodating at least a part of the sideward tongue 122 of a further tile, said recess 123 being defined by an upper lip 124 and a lower lip 125, wherein the first mechanical coupling profiles 109, 110 allow locking together of adjacent tiles 100 by inward angling whereby at least a part of the sideward tongue 122 is received by the recess 123. The bottom back region of the sideward tongue 122 of the first coupling profile 109 is configured as bearing region. The lower lip 125 of the second coupling profile 110 is provided with an upwardly protruding shoulder for supporting and/or facing the bearing region of the sideward tongue 122. The sideward tongue 122 is designed such that locking takes place by an introduction movement into the recess 123 of a further tile and a angling down movement about an axis parallel to the first coupling profile 109, as a result of which a top side of the sideward tongue 122 will engage the upper lip 124 and the bearing region of the sideward tongue will be supported by and/or will be facing the shoulder of the lower lip 125, leading to locking of adjacent tiles 100*a*, 100*b* at the first and second edges 101, 102 in both horizontal direction and vertical direction.

Figure 3C:
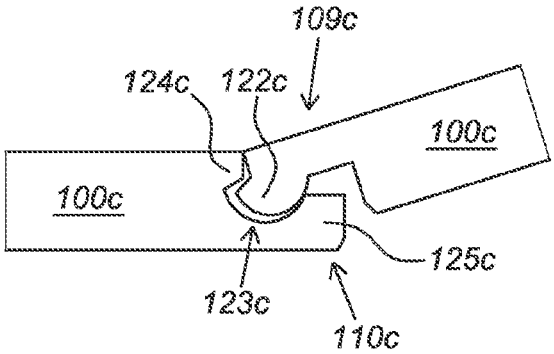
FIG. 3*c-g* alternative configuration of the coupling profiles of the tiles shown in FIGS. 3*a* and 3*b;*
Figure 3D:
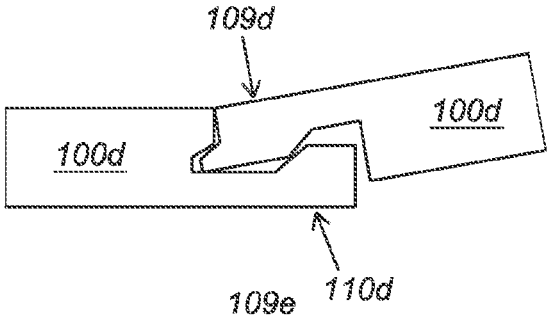
Figure 3E:
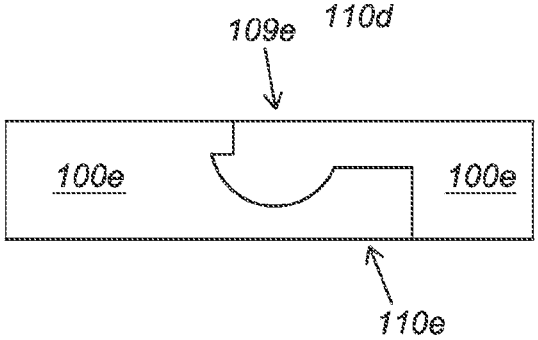
Figure 3F:
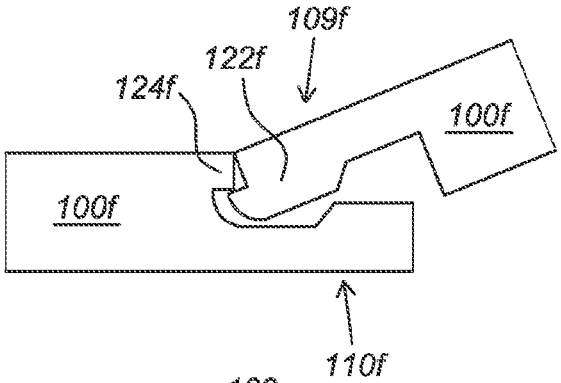
Figure 3G:
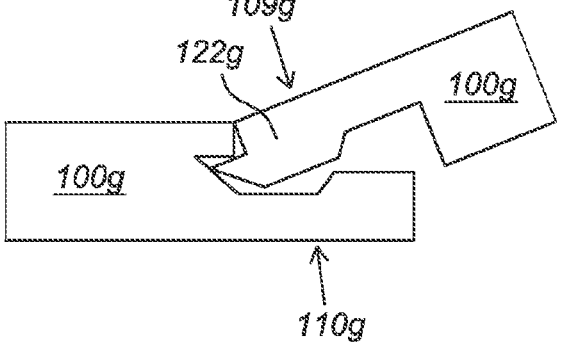

FIGS. 3*c-g* show different alternative embodiments of the first coupling profile 109*c-g* and the second coupling profile 110*c-g* which can be present at the first edge 101*c-g* and the second edge 102*c-g* of a tile 100*c-g* according to the invention. One or more of these coupling profiles 109*c-g*, 110*c-g* may be applied to the tile 101 as shown in FIG. 1. FIG. 3*c* show that a front region of the sideward tongue 122*c* of the first coupling profile 109*c* is provided with a rounded bottom surface. An outer end of the rounded bottom surface adjoins an inclined locking surface. An opposite end of the rounded bottom surface adjoins a bearing surface making part of a back region of the sideward tongue 122*c*. The second coupling profile 110*c* includes an upper lip 124*c* and a lower lip 125*c* defining a recess 123*c*. Both lips 124*c*, 125*c* are integrally connected to the base layer of the tile 100*c*. FIG. 3*d* shows a first and second coupling profile 109*d*, 110*d* of a tile 100*d*, wherein, instead of a smoothly rounded bottom portion a more hooked (segmented rounded) bottom portion is shown. In FIG. 3*e*, an embodiment of a tile 100*e* is shown which is almost identical to the tile shown in FIG. 3*c*, though wherein the first and second coupling profiles 109*e*, 110*e* are provided with horizontal locking surfaces instead of inclined locking surfaces. In FIG. 3*f*, an alternative embodiment of a tile 100*f* is shown, wherein the first and second coupling profiles 109*f*, 110*f* are shaped such that a bottom contact portion between the two coupling profiles 109*f*, 110*f* is partially smoothly rounded and partially discontinuously rounded (segmented rounded). The locking surfaces of a sideward tongue 122*f* of the first coupling profile 109*f* and of an upper lip 124*f* of the second coupling profile 110*f* have a substantially horizontal orientation. In FIG. 3*g*, an embodiment of a tile 100*g* almost identical to the tile 100*f* as shown in FIG. 3*f* is shown, with the difference that a front bottom part of a sideward tongue 122*g* is not smoothly rounded, but flat giving a bottom portion of the sideward tongue 122*g* as such a segmented rounded (hooked) shape.

Figure 4:
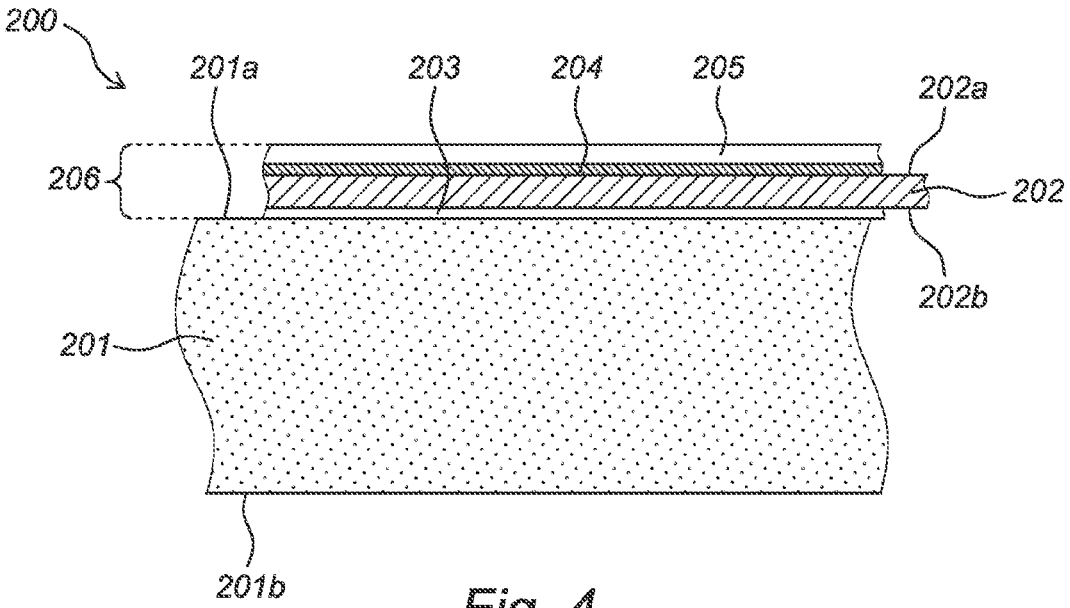
FIG. 4 a schematic representation of a side view of the laminate details of a first possible embodiment of a tile according to the invention.

FIG. 4 show a schematic representation of a side view of the laminate details of a first possible embodiment of a tile 200 according to the invention. The tile 200 includes a substantially rigid base layer 201 at least partially made of a foamed composite including at least one a closed cell foam plastic material and at least one filler. The base layer 201 includes a lower side or bottom surface 201*b* and an upper side 201*a*. The coupling profiles are generally provided at the rigid base layer 201. The tile 100 includes an upper substrate 202 affixed to the upper side 201*a* of the base layer 201. An adhesive 203, which can be a layer or coating, is provided between the upper surface 201*a* of the rigid base layer 201 and the lower surface 202*b* of the upper substrate layer 202 to join the upper substrate layer 202 and the rigid base layer 201 together. The tile 200 can possibly include a design pattern or a decorative appearance of any selected type on or at the upper surface 202*a* of the substrate layer 202. The design pattern can be a wood grain design, a mineral grain design that resembles marble, granite or any other natural stone grain, or a colour pattern, colour blend or single colour to name just a few design possibilities. The decoration or design pattern can be printed onto or otherwise applied to the upper surface 202*a* of the upper substrate layer 202, but is preferably provided on a separate printing film or decorative layer 204 of any suitable known plastic material. The decorative layer 204 is covered by a transparent or semi-transparent abrasion resistant wear layer 205 of known material and fabrication through which the design layer 204 can be viewed. The top of the wear layer 205 is the top surface of the tile 100. Possibly a transparent finishing layer (not shown) can be situated in between the decorative layer 204 and the wear layer 205. The tile 100 can be provided with any of the coupling elements shown in the previous figures. The upper substrate layer 202, the design layer 204 and the wear layer 205 can be initially laminated together to form an upper substrate laminate subassembly 206. The laminate subassembly 206 and the base layer 201 can then be laminated together to form the tile 200. Coupling profiles are typically applied to one or both pairs of opposing edges of the tile 200, wherein examples of these coupling profiles are shown in FIGS. 1-3*g*. The tile 200 shown in this FIG. 4 may be the same tile as shown in one of FIGS. 1-3*g*.

Figure 5:
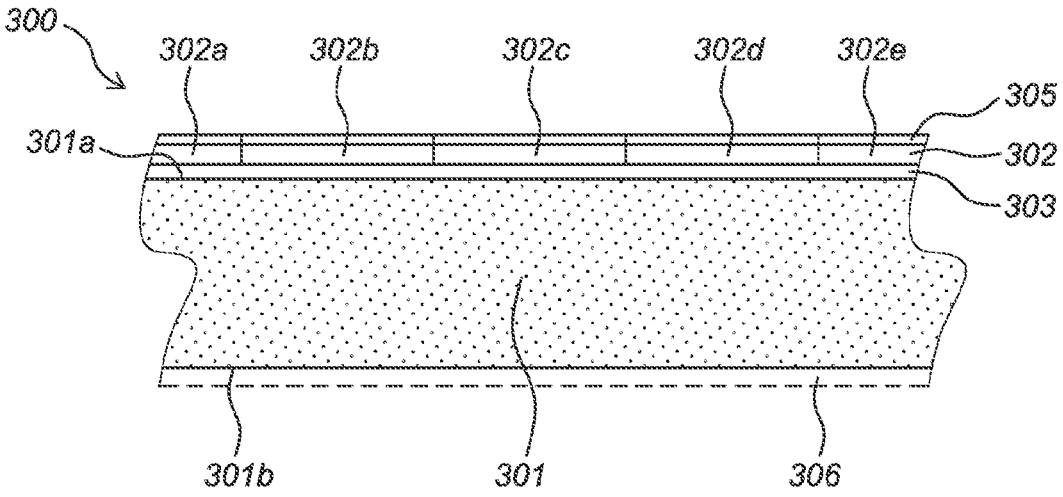
FIG. 5 show a schematic representation of a side view of the laminate details of a second possible embodiment of a tile according to the invention.

FIG. 5 show a schematic representation of a side view of the laminate details of a second possible embodiment of a tile 300 according to the invention. The tile 300 includes a substantially rigid base layer 301 at least partially made of a composite of at least one plastic material and at least one filler, wherein the composite and/or the at least one plastic material includes and/or is formed by a closed cell foam. It is also possible that the substantially rigid base layer 301 is at least partially made of a non-foamed (solid) composite including at least one plastic material and at least one filler. The tile 300 includes a plurality of strip shaped upper substrates 302*a-e* affixed to the upper side 301*a* of the base layer 301. The plurality of strip shaped upper substrates 302*a-e* can be pre-assembled before they are affixed to the base layer 301. The upper substrates 302*a-e* are affixed to the upper side 301*a* of the base layer 301 by means of an adhesive 303. However, it is also possible that the upper substrates 302*a-e* are affixed to the upper side 301*a* of the base layer 301 by means of a high pressure and high pressure treatment. The upper substrates 302*a-e* are covered by a transparent or semi-transparent abrasion resistant wear layer 305 of known material and fabrication. The upper substrates 302*a-e* have a parallel orientation. The profiling of a tile 300 is generally done after the laminating of the tile 300. The coupling profile will provided in the rigid base layer 301. If an underlayment 306 or backing 306 (shown in dotted lines) is used, the underlayment 306 is affixed to a lower side 301*b* of the base layer 301 after the profiling step. The underlayment 306 can for example be made of polyethylene (PE), polyurethane or cork.

Figure 6A:
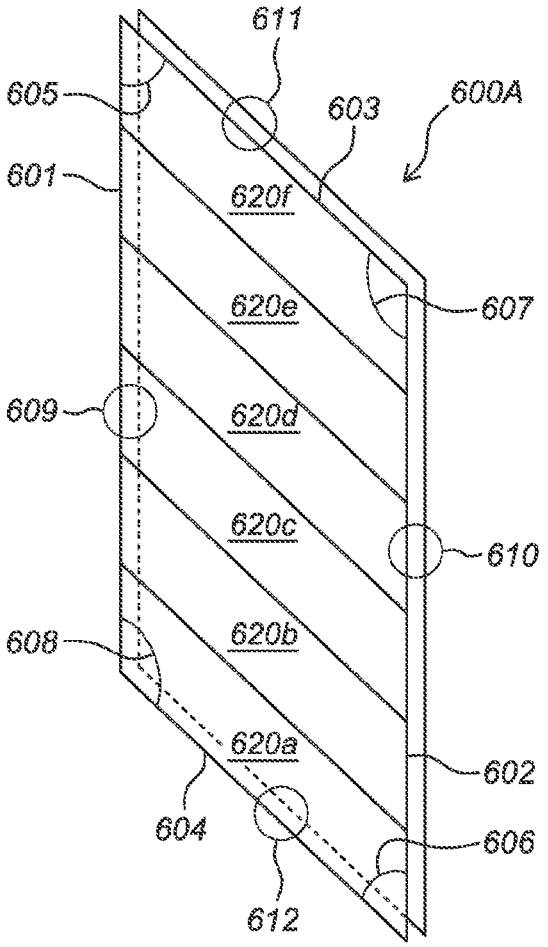
FIG. 6*a* a schematic representation of a first type of tile for use in a multi-purpose tile system according to the invention.
Figure 6B:
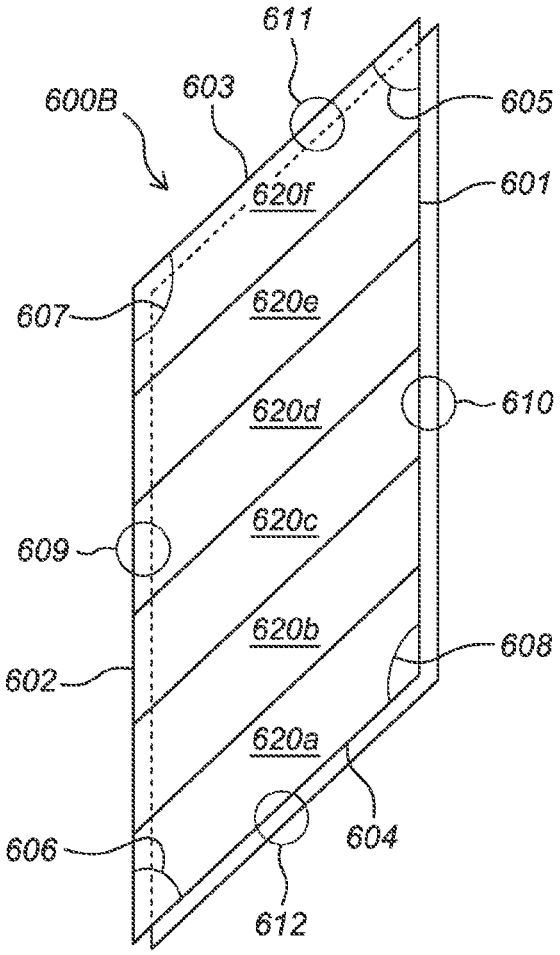
FIG. 6*b* a schematic representation of a second type of tile for use in multi-purpose tile system according to the invention.

FIGS. 6*a* and 6*b* show schematic representations of two different types of tile configurations, wherein the first mechanical coupling means of one type of tile (A) along the first pair of opposite edges are arranged in a mirror-inverted manner relative to the corresponding first mechanical coupling means along the same first pair of opposite edge portions of the other type of tile (B). The figures show a top view. FIG. 6*a* shows a tile 600A wherein the first coupling profile 609 is arranged at the first edge 601, the second coupling profile 610 is arranged at the second edge 602, the third coupling profile 611 is arranged at the third edge 603 and the fourth coupling profile 612 is arranged at the fourth edge 604. FIG. 6*b*, however, shows a tile 600B with a configuration wherein the first coupling profile 609 is arranged at the second edge 602, the second coupling profile 610 is arranged at the first edge 601, the third coupling profile 611 is arranged at the third edge 603 and the fourth coupling profile 612 is arranged at the fourth edge 604. The coupling profiles 609, 610, 611, 612 can be any of the coupling profiles as shown in the embodiments of FIGS. 1-3*g*. For both A and B type of tiles the first edge 601 and the third edge 603 enclose a first acute angle 605, and wherein the second edge 602 and the fourth edge 604 enclose a second acute angle 606 opposing said first acute angle 605, and the second edge 602 and the third edge 603 enclose a first obtuse angle 607, and wherein the first edge 601 and the fourth edge 604 enclose a second obtuse angle 608 opposing said first obtuse angle 607. Each tile 600A, 600B includes a substantially rigid base layer at least partially made of a composite including a closed cell foam plastic material and at least one filler. Each tile 600A, 600B furthermore includes a plurality of strip shaped upper substrates 620*a-f* affixed to an upper side of the base layer, wherein said upper substrates 620*a-f* are arranged side by side in the same plane in a parallel configuration. Both the tiles 600A, 600B and the strip shaped upper substrates 620*a-f* have the shape of a parallelogram. When interconnecting multiple tiles 600A, 600B as shown in FIGS. 6*a* and 6*b*, the upper substrates 620*a-f* will form a chevron pattern. This will be shown in more detail in FIG. 8. The upper substrates 620*a-f* include a decorative layer and an abrasion resistant wear layer covering said decorative layer. From aesthetic point of view it is desirable is the decorative layers of at least two adjacently arranged upper substrates 620*a-f* have different appearances as this may accentuate the chevron pattern. The plurality of upper substrates 620*a-f* substantially completely cover the upper surface of the base layer of the tiles 600A, 600B. Each of the plurality of upper substrates 620*a-f* therefore extends from the first edge 601 to the second edge 602 of the tile 600A, 600B. The upper substrates 620*a-e* have a parallel orientation wherein the longitudinal direction of each upper substrate 620*a-e* is in line with the third edge 603 and the fourth edge 604 of the tile 600A, 600B. The ideal number and dimensions of upper substrates 620*a-f* is amongst others dependent on the dimensions of the tile 600A, 600B. In the shown embodiments of tiles 600A, 600B is the length of the first edge 601 of a tile 600A, 600B substantially identical to the length of the second edge 602 of the tile 600A, 600B. This length is greater than the length of the third edge 603 and the fourth edge 604 of said tile 600A, 600B. The first acute angle 605 and the second acute angle 606 are situated between 30 and 60 degrees, and are preferably substantially 45 degrees. The first obtuse angle 607 and the second obtuse angle 608 are situated between 120 and 150 degrees, and are preferably substantially 135 degrees.

Figure 7:
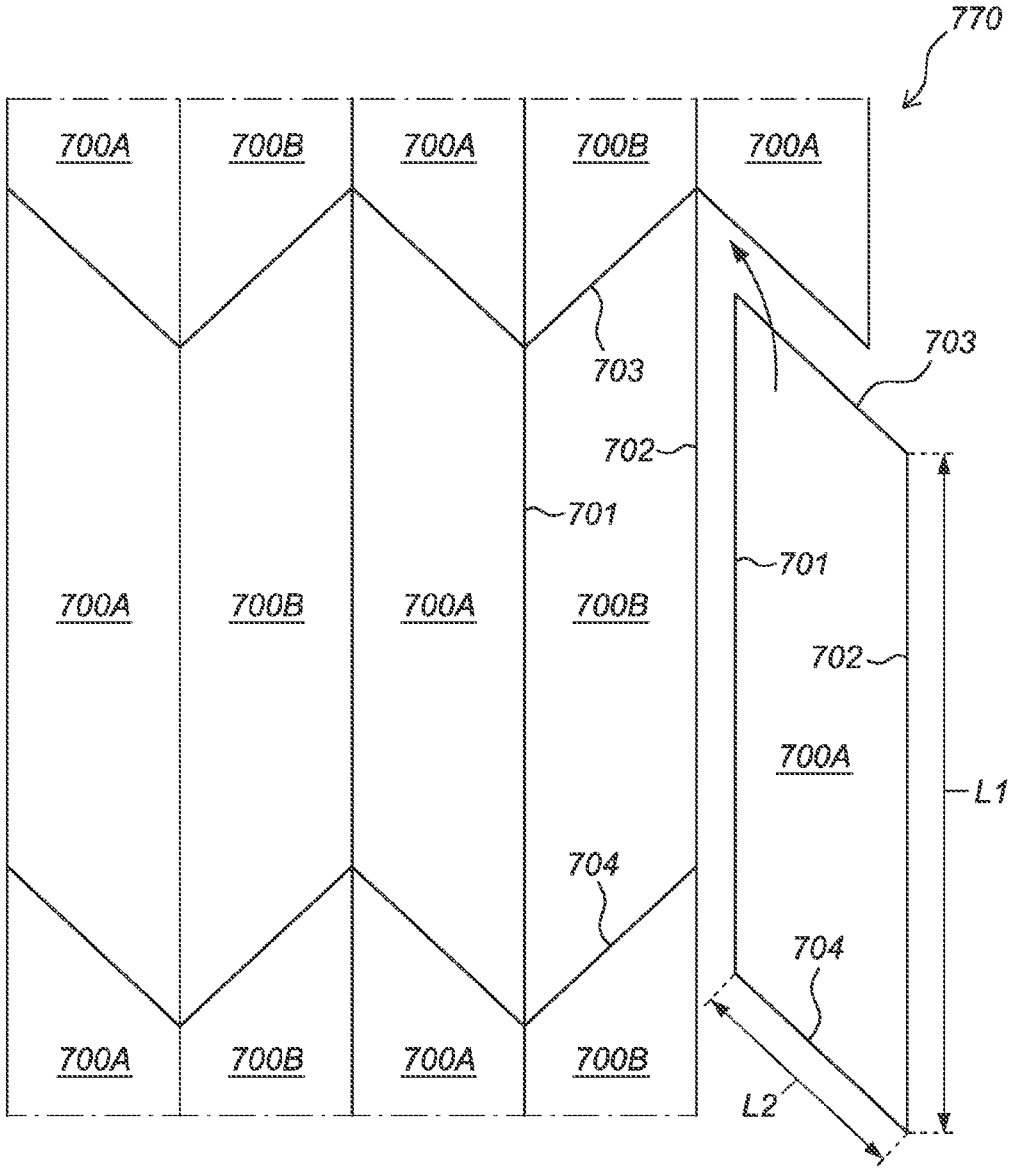
FIG. 7 a schematic representation of a first example of a multi-purpose tile system according to the invention.

FIG. 7 shows a schematic representation of a first example of a multi-purpose tile system 770 according to the invention including a plurality of multi-purpose tiles 700A, 700B. The figure shows a top view. The system 770 includes two different types of tiles 700A, 700B. In the shown embodiments of tiles 700A, 700B are the lengths (L1) of the first edge 701 and the second edge 702 of a tile 700A, 700B significantly greater than the length (L2) of the third edge 703 and the fourth edge 704 of said tile 700A, 700B. For this configuration it is beneficial if the first edge 701 and the second edge 702 include coupling profiles arranged for inward angling of adjacent tiles 700A, 700B and that the third edge 703 and the fourth edge 704 include coupling profiles arranged for further locking of the tiles 700A, 700B. Examples of the possible coupling profiles which can be applied are shown in FIGS. 1-3*g*.

Figure 8:
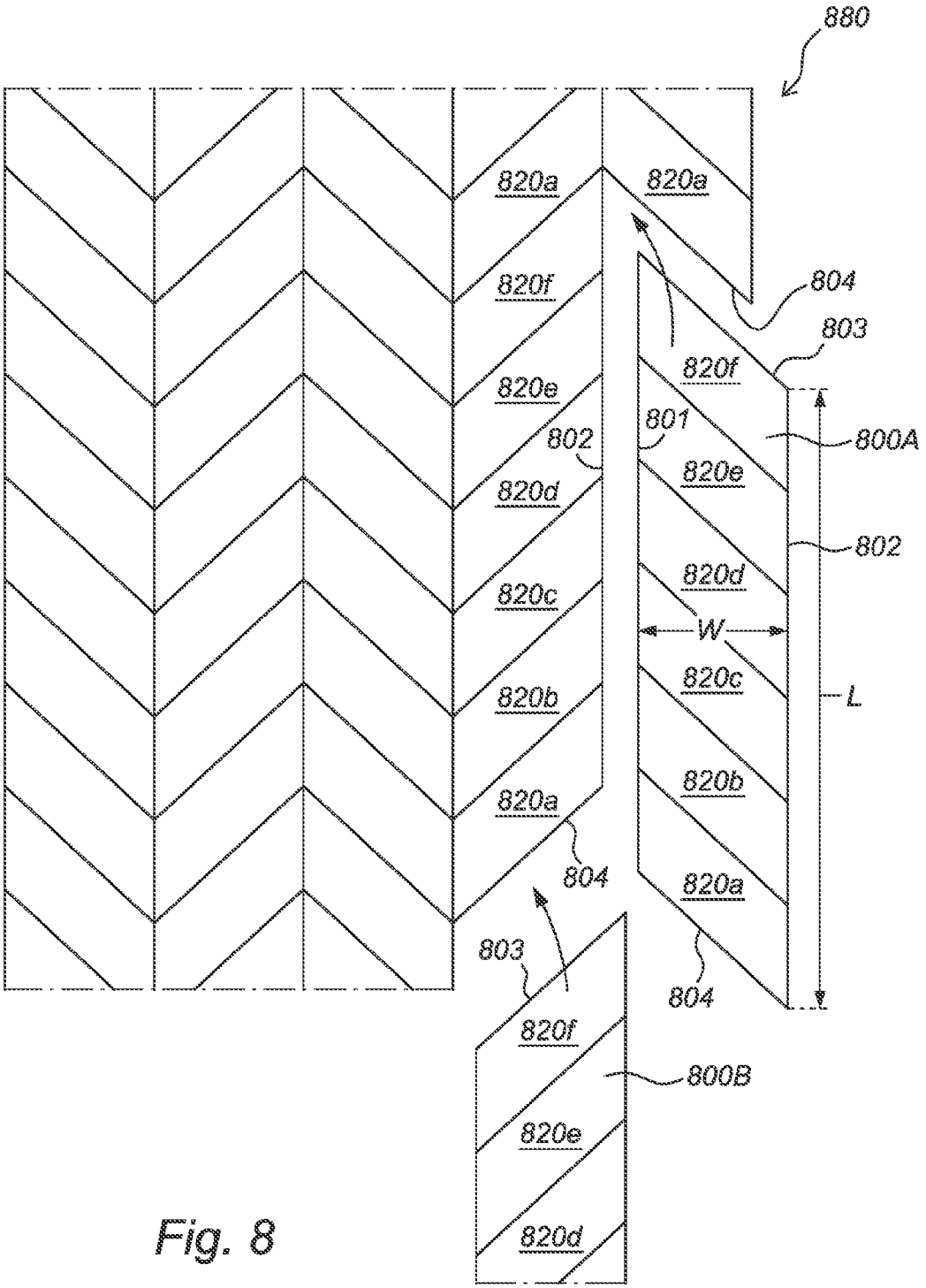
FIG. 8 a schematic representation of a second example of a multi-purpose tile system according to the invention.

FIG. 8 shows a schematic representation of a second example of a multi-purpose tile system 880 according to the invention including a plurality of multi-purpose tiles 800A, 800B. The figure shows a top view. The tiles 800A, 800B are equivalent to the tiles 600A, 600B shown in FIGS. 6*a* and 6*b*, and having equivalent coupling profiles of which examples are also shown in FIGS. 1-3*g*. The tiles 800A, 800B have the shape of a parallelogram, wherein opposing edges 801, 802, 803, 804 have a similar length and adjacent edges differ in length. Each tile 800A, 800B includes a plurality of strip shaped upper substrates 820*a-f* affixed to an upper side of the base layer. The upper substrates 820*a-f* are parallel oriented. The longitudinal direction of each upper substrate 820*a-f* of a tile 800A, 800B is substantially parallel to the short edges of the tile 800A, 800B. The longitudinal direction of a tile 800A, 800B therefore differs from the longitudinal direction of an upper substrate 820*a-e* affixed thereto. When the tiles 800A, 800B are in a joined configuration, as is for example shown in the left side of the figure, the plurality of upper substrates 820*a-e* of a tile form a continuation of the upper substrates 820*a-e* of an adjacent tile in longitudinal direction of the tile. This means that the upper substrates 820*a-e* of an A-type of tile 800A are substantially parallel to the upper substrates of an adjacent A-type of tile 800A. The same applies to B-type of tiles 800B. Due to this configuration of upper substrates 820*a-e*, it will be difficult or even impossible to observe that the upper substrates 820*a-e* are not individual tiles which are mutually connected during formation of the tile system. It is a benefit of the configuration that not all the upper substrates 820*a-e* which visualize the chevron pattern have to be mutually joined. Due to the tiles 800A, 800B including a substantially rigid base layer at least partially made of a foamed composite including at least one plastic material and at least one filler, the tiles 800A, 800B have sufficient rigidity to have relatively large dimensions. The first edge 801 and second edge 802 can for example be up to 2 meter in length (L). The width (W) of the tile can for example be 30-50 centimetre. Therefore the system according the invention can significantly reduce the required time for installation of the tile system 880 compared to a system including conventional tiles which are in the dimensions of an upper substrate 820*a-e* which conventional system visually seen looks similar.

Figure 9:
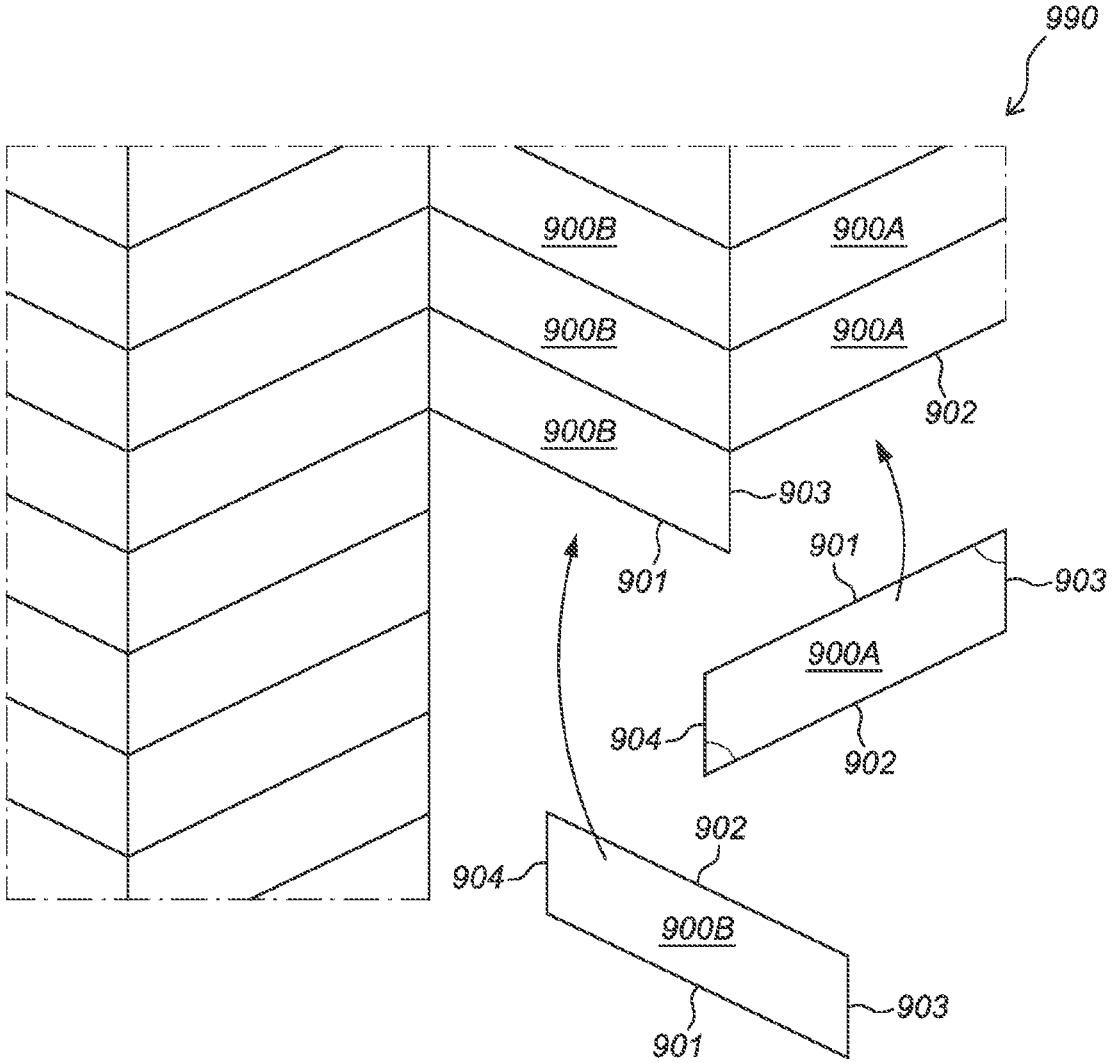
FIG. 9 a schematic representation of a third example of a multi-purpose tile system according to the invention.

FIG. 9 show a schematic representation of a third example of a multi-purpose tile system 990 according to the disclosure including a plurality of multi-purpose tiles 900A, 900B. The figure shows a top view. The tiles 900A, 900B are equivalent to the tiles 700A, 700*b* shown in FIG. 7, however the tiles 900A, 900B are joined in a different manner which results in different tile pattern of the tile system 990. The edges 901, 902, 903, 904 can be provided with coupling profiles as described in the previous figures. It is also possible that the tiles 900A, 900B have the shape of a rhombus or a rhomboid. Installation of the tile system 990 can be realized by inward angling of a sideward tongue of a first tile 900A, 900B to be installed into a recess of an already installed second tile 900A, 900B, which is typically—though not necessarily—realized by angling down the tile 900A, 900B to be installed with respect to the already installed tile 900A, 900B, which will lock the first tile 900A, 900B and the second tile 900A, 900B at least in vertical direction, but preferably also in horizontal direction. During this inward angling of the first tile 900A, 900B and the second tile 900A, 900B, commonly the fourth coupling profile of the first tile 900A, 900B to be installed will be connected (simultaneously) to the third coupling profile of another already installed third tile 900A, 900B, which is typically realized by lowering the first tile 900A, 900B with respect to the third tile 900A, 900B during which the third coupling profile and the fourth coupling profile will be scissored (zipped) into each other, which results in a locking of the first tile 900A, 900B with respect to the third tile 900A, 900B both in horizontal and vertical direction.

Figure 10:
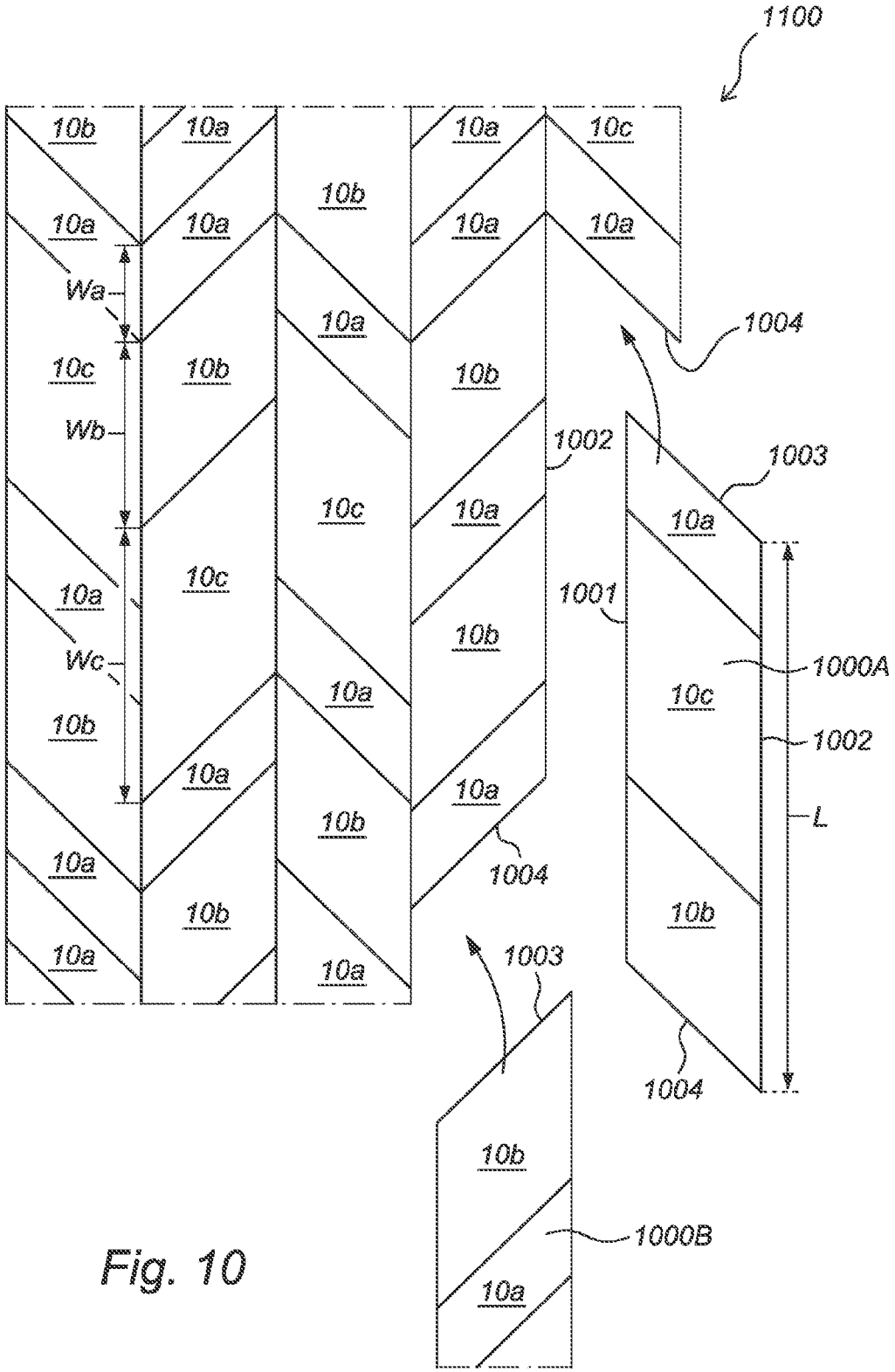
FIG. 10 a schematic representation of a fourth example of a multi-purpose tile system according to the invention.

FIG. 10 shows a schematic representation of a fourth example of a multi-purpose tile system 1100 according to the disclosure including a plurality of multi-purpose tiles 1000A, 1000B. The figure shows a top view. The tiles 1000A, 1000B are equivalent to the tiles shown in FIGS. 6*a* and 6*b* having equivalent coupling profiles at the first, second, third and fourth edge 1001, 1002, 1003, 1004, of which examples are also shown in FIGS. 1-3*g*. The multi-purpose tile system 1100 as shown in this figure has similarities with the systems 770, 880 as shown in FIGS. 7 and 8. The main difference can be found in the non-uniformity of the upper substrates 10*a*, 10*b*, 10*c* of the tiles 1000A, 1000B. Each tile 1000A, 1000B includes a plurality of strip shaped upper substrates 10*a-c* affixed to an upper side of the base layer. The upper substrates 10*a-c* are parallel oriented to each other. The number of upper substrates 10*a-c* can vary per tile 1000A, 1000B as the width Wa, Wb, Wc of the upper substrates 10*a-c* can vary. The width Wa, Wb, Wc is defined in a longitudinal direction L of the tile 1000A, 1000B. When the tiles 1000A, 1000B are in a joined configuration, as is for example shown in the left side of the figure, the plurality of upper substrates 10*a-c* form a non-uniform pattern of upper substrates 10*a-c*. Despite the upper substrates 10*a-c* shown all have a parallelogrammatic shape, it is also possible that the shape of the upper substrate deviates thereof.

Figure 11:
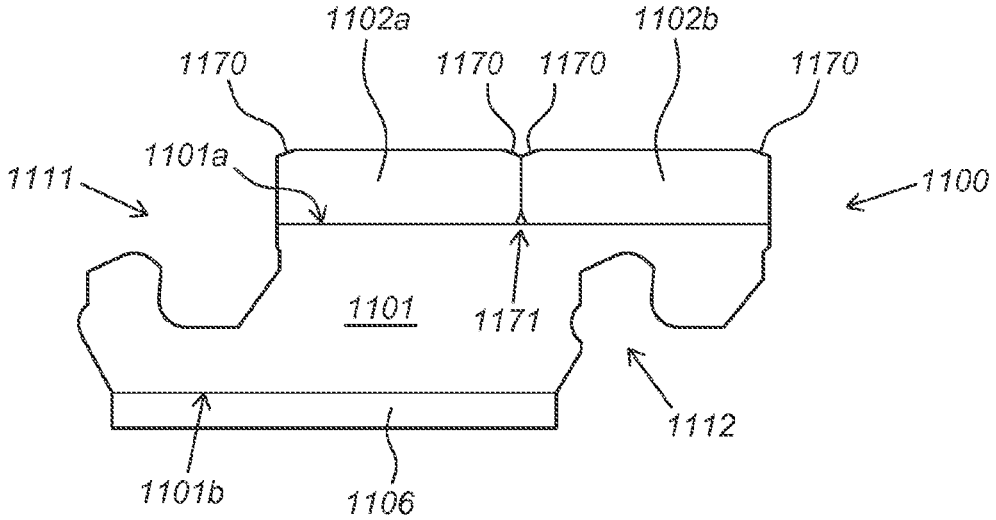
FIG. 11, a schematic cross-section of a tile according to the invention.

FIG. 11 shows a schematic cross-section of a tile 1100 according to the present disclosure. The cross-section is comparable to the cross-sections of line A-A' of the tile 100 as shown in FIG. 1. The coupling profiles 1111, 1112 are equivalent to the coupling profiles shown in FIGS. 2*a* and 2*b*, however further possible examples of coupling profiles which can be used are shown in FIGS. 1-3*g*. The tile 1100 includes a substantially rigid base layer 1101 at least partially made of a composite of at least one plastic material and at least one filler, wherein the composite and/or the at least one plastic material includes and/or is formed by a closed cell foam. The tile 1100 includes a plurality of strip shaped upper substrates 1102*a*, 1102*b* affixed to the upper side 1101*a* of the base layer 1101. The plurality of strip shaped upper substrates 1102*a*, 1102*b* can be pre-assembled before they are affixed to the base layer 1101. The upper substrates 1102*a*, 1102*b* may for example be affixed to the upper side 1101*a* of the base layer 1101 by means of an adhesive. The upper substrates 1102*a*, 1102*b* are typically covered by a transparent or semi-transparent abrasion resistant wear layer. A backing layer 1106 is affixed to a lower side 1101*b* of the base layer 1101 after the profiling step. The upper substrates 1102*a*, 1102*b* have a parallel configuration, and facing longitudinal edges of the adjacent strip shaped upper substrates 1102*a*, 1102*b* are provided, near the top side, with a bevel 1170. Each bevel 1170 is provided at facing longitudinal edges of a shaped upper substrate 1102*a*, 1102*b* and is formed by a cut-away portion and/or imprinted portion of the wear layer. The bevels 1170 are applied to prevent visible seam formation, and secures a seamless engagement of adjacent upper substrates 1102*a*, 1102*b*. Each strip shaped upper substrate 1102*a*, 1102*b* typically includes a back layer situated in between the base layer 1101 and the decorative layer of said upper substrate 1102*a*, 1102*b*. The width of a top portion of the back layer is in a preferred embodiment larger than the width of a bottom portion of the back layer, typically as seen in cross-section, as can also be seen in FIG. 12. This may result in improved seamless and tight engagement of adjacent upper substrates 1102*a*, 1102*b*. The bottom portion of opposing longitudinal edges of the back layer is preferably chamfered. FIG. 11 shows that the upper substrate 1102*a*, 1102*b* are positioned rather tightly next to each other, and since a narrowing width of the bottom portion of the upper substrates 1102*a*, 1102*b* are applied, a small air channel 1171 is formed in between the adjacent upper substrates 1102*a*, 1102*b*, at the bottom side of said upper substrates.

Figure 12:
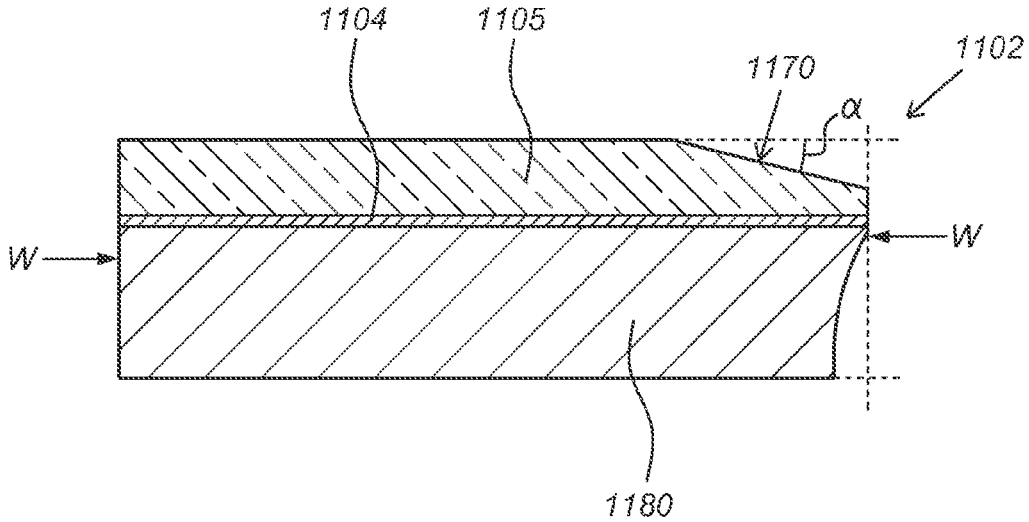
FIG. 12 a detailed cross-section of an upper substrate as used in the tile according to FIG. 11.

FIG. 12 shows a detailed cross-section of an upper substrate 1102 as used in the tile 1100 according to FIG. 11. The figure shows that the strip shaped upper substrate 1102 includes: a decorative layer 1104 and an abrasion resistant wear layer 1105 covering said decorative layer 1104. A top surface of said wear layer 1105 is the top surface of the tile 1100. The wear layer 1105 is typically made of a transparent and/or translucent material, such that decorative layer 1104 is visible through the transparent wear layer 1105. The longitudinal edges of the strip shaped upper substrate 1102 is provided with a bevel 1170. The bevel 1170 is applied to prevent visible seam formation, and secures a seamless engagement of adjacent upper substrates 1102. The bevel 1170 is formed by a cut-away portion of the wear layer 1105. Hence, in the shown embodiment, the bevel 1170 is positioned above the decorative layer 1104, wherein the bevel 1170 leaves the decorative layer 1104 intact. The bevel 1170 typically has an angle (alpha) between 10 and 30 degrees below the horizontal surface as defined by the top surface of the tile. The angle of the bevel 1170 in the shown embodiment is about 15 degrees. It is conceivable that a transparent finishing layer situated in between the decorative layer 1104 and the wear layer 1105. The strip shaped upper substrate 1102 includes a back layer 1180 situated in between the base layer of the tile (not shown) and the decorative layer 1104.

The back layer 1180 is preferably made of thermoplastic material, such as PVC or PET. Preferably, the back layer 1180 thickness is at least 50% of the thickness of the upper substrate. It can be seen that the width (W) of a top portion of the back layer 1180 is larger than the width of a bottom portion of the back layer 1180.

Figure 13:
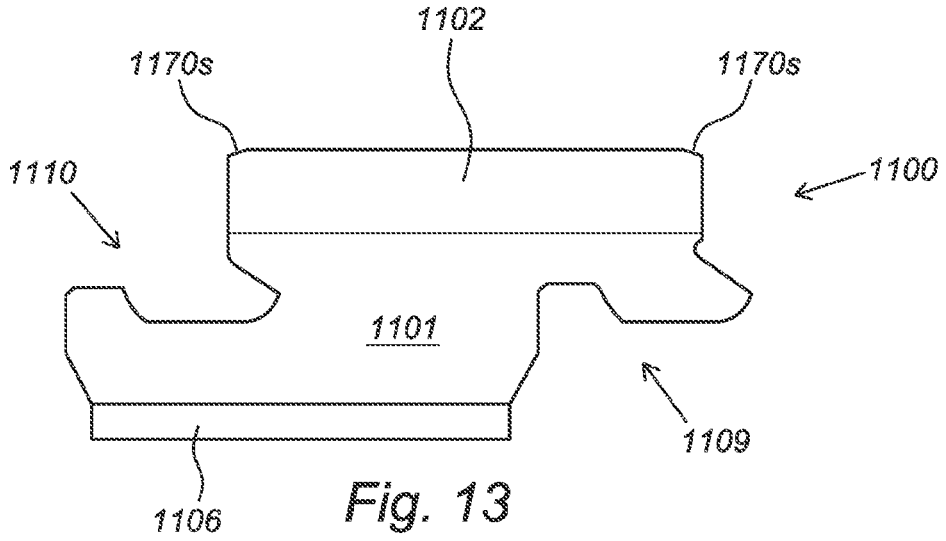
FIG. 13 another schematic cross-section of the tile as shown in FIG. 11.

FIG. 13 shows another schematic cross-section of the tile as shown in FIG. 11. The cross-section is comparable to the cross-sections of line B-B' of the tile 100 as shown in FIG. 1. The coupling profiles 1111, 1112 are equivalent to the coupling profiles shown in FIGS. 3*a* and 3*b*, however further possible examples of coupling profiles which can be used are shown in FIGS. 1-3*g*. It can be seen that the short edges of the upper substrate 1102 is also provided with a bevel 1170*s*, near the top surface, which allows or facilitates adjacent tiles to engage seamless to each other.

Figure 14:
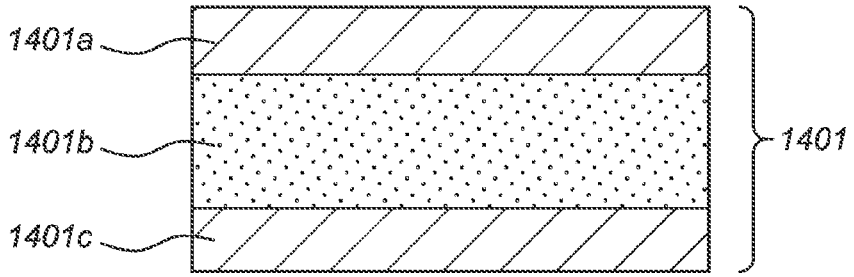
FIG. 14 a cross-section of a multilayer base layer for use in a tile according to the invention.

FIG. 14 shows a cross-section of a multilayer base layer 1401 for use in a tile according to the present disclosure. The figure shows that the base layer 1401 includes basically three layers 1401*a*, 1401*b*, 1401*c*. The upper layer 1401*a* and the bottom layer 1401*c* enclose a foamed mid layer 1401*b*. Hence, a laminate of composite layers 1401*a*, 1401*b*, 1401*c* stacked on top of each other is formed. This a multilayer base layer 1401 may, for example, be formed by co-extrusion. It can be seen that the different composite layers 1401*a*, 1401*b*, 1401*c* of the base layer 1401 have a different composition. The upper layer 1401*a* and the bottom layer 1401*c* have a (rather) solid structure, while the mid layer 1401 has a foam structure. Therefore, a sandwiched structure wherein two substantially solid composite layers 1401*a*, 1401*c* enclosing a foam composite layer 1401*b* is obtained.

Figure 15:
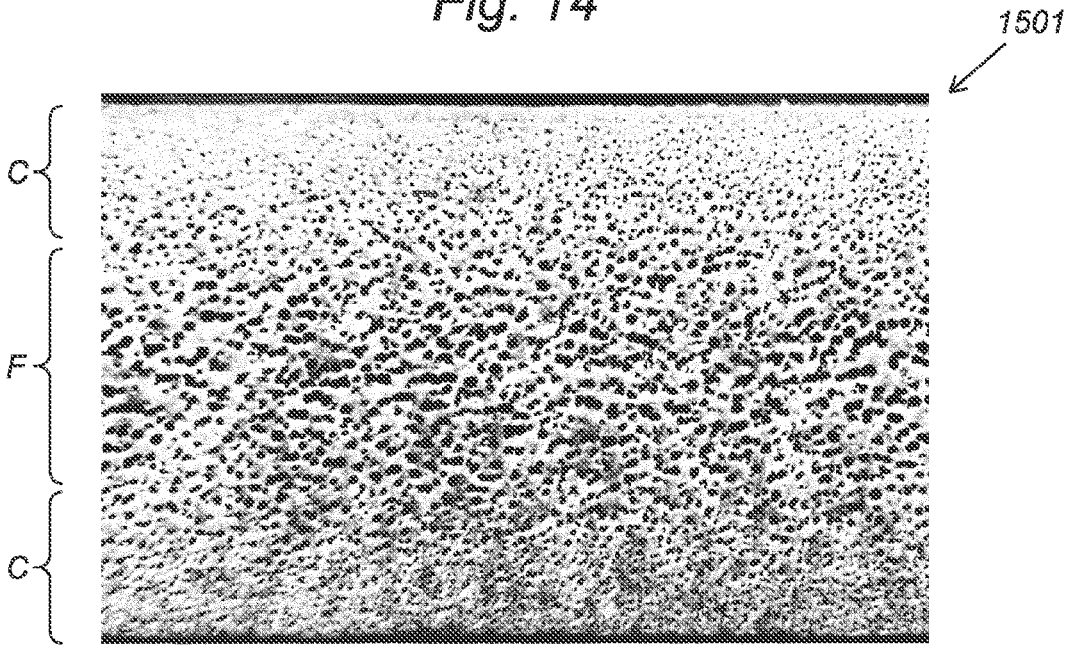
FIG. 15 a detailed cross-section of a foamed base layer for use in a tile according to the invention.

FIG. 15 shows a detailed cross-section of a further example of a foamed base layer 1501 for use in a tile according to the present disclosure. It can be seen that curst layers (C) are formed within the foamed base layer 1501 both at a top section (top portion) and a bottom section (bottom portion) of the foamed base layer 1501. This crust layers form integral part of the base layer 1501. Further, the crust layers of the top section and the bottom section of the base layer 1501 enclosing the foam structure (F). Each crust layer has a relatively closed cell structure. It can be seen that the crust layers C have a reduced porosity compared to the more porous foam structure F. The center section of the foamed base layer 1501 is enclosed by both crust layers. The foamed center section has a larger thickness than the thickness of a crust layer. The center section has a substantially homogeneous cell size. The average cell size of the foamed section F of the foamed base layer 1501 is typically situated in between 60 and 140 micron, more in particular between 80 and 120 micron.

It will be apparent that the disclosure is not limited to the working examples shown and described herein, but that numerous variants are possible within the scope of the attached claims that will be obvious to a person skilled in the art. Moreover, one or more details and technical features mentioned in the above description of various embodiments of the tile according to the disclosure may be incorporated in the tiles as shown in the figures and as described above. Hence, the above-described inventive concepts are illustrated by several illustrative embodiments. It is conceivable that individual inventive concepts may be applied without, in so doing, also applying other details of the described example. It is not necessary to elaborate on examples of all conceivable combinations of the above-described inventive concepts, as a person skilled in the art will understand numerous inventive concepts can be (re)combined in order to arrive at a specific application.

The verb "include" and conjugations thereof used in this patent publication are understood to mean not only "include", but are also understood to mean the phrases "contain", "substantially consist of", "formed by" and conjugations thereof.

The invention claimed is:

1. A multi-purpose tile system comprising a plurality of multi-purpose tiles wherein each of the plurality of multi-purpose tiles are configured to being joined in a chevron pattern, wherein each tile comprises:

a first pair of opposing edges comprising a first edge and an opposite second edge;

a second pair of opposing edges comprising a third edge and an opposing fourth edge, wherein:

the first edge and the third edge enclose a first acute angle, and wherein the second edge and the fourth edge enclose a second acute angle opposing said first acute angle, and wherein the second edge and the third edge enclose a first obtuse angle, and wherein the first edge and the fourth edge enclose a second obtuse angle opposing said first obtuse angle, and wherein the first pair of opposing edges have pairs of opposing first mechanical coupling means for locking together said tiles at least vertically, comprising:

a first coupling profile comprising a sideward tongue extending in a direction substantially parallel to an upper side of the tile, and an opposing second coupling profile comprising a recess configured for accommodating at least a part of the sideward tongue of a further tile, said recess being defined by an upper lip and a lower lip, wherein said first mechanical coupling profiles allow locking together said tiles by inward angling whereby at least a part of the sideward tongue is received by the recess, and wherein the second pair of opposing edges have pairs of opposing second mechanical coupling means for locking together said tiles vertically and horizontally, comprising:

a third coupling profile, comprising an upward tongue, at least one upward flank lying at a distance from the upward tongue and an upward groove formed between the upward tongue and the upward flank, wherein at least a part of a side of the upward tongue facing the upward flank is inclined toward the upward flank, and wherein at least a part of a side of the upward tongue facing away from the upward flank comprises at least one first locking element, which makes integral part of the upward tongue, wherein the at least one first locking element comprises a bulge, and a fourth coupling profile, comprising a downward tongue, at least one downward flank lying at a distance from the downward tongue, and a downward groove formed between the downward tongue and the downward flank, wherein at least a part of a side of the downward tongue facing the downward flank is inclined toward the downward flank, and wherein the downward flank comprises at least one second locking element, which makes integral part of the downward flank, and adapted for co-action with the at least one first locking element of yet a further tile, wherein the at least one second locking element comprises a recess, wherein the second mechanical coupling profiles allow locking together said tiles during inward angling of the first coupling profile of a tile and the second coupling profile of another tile, wherein the fourth coupling profile of the tile to be coupled makes a scissoring movement toward the third coupling profile of yet another tile, leading to locking of the third coupling profile and the fourth coupling profile, wherein each tile comprises a substantially rigid base layer at least partially made of a non-foamed composite comprising at least one plastic material and at least one filler, wherein at least one tile comprises at least one upper substrate affixed to an upper side the base layer, wherein said upper substrate comprises a decorative layer wherein at least one tile comprises a plurality of strip shaped upper substrates affixed to an upper side the base layer, wherein said upper substrates are arranged side by side in the same plane, in a parallel configuration, and wherein facing longitudinal edges of at least two strip shaped upper substrates are provided, near the top side, with a bevel, wherein the system comprises two different types of tiles (A and B respectively), and wherein the first mechanical coupling means of one type of tile along the first pair of opposite edges are arranged in a mirror-inverted manner relative to the corresponding first mechanical coupling means along the same first pair of opposite edge portions of the other type of tile, and wherein the fourth coupling profile comprises an upper bridge connecting the downward tongue to the base layer, wherein the third coupling profile comprises a lower bridge connecting the upward tongue to the base layer, wherein a thickness of the lower bridge is either substantially the same or thicker than a thickness of the upper bridge, wherein the upper bridge is configured to deform, during coupling of adjacent tiles, to widen the downward groove, and wherein a lower side of the upper bridge of the second coupling profile is at least partially inclined.

2. The multi-purpose tile system according to claim 1, wherein at least one tile has a configuration wherein:

the first coupling profile is arranged at the first edge;

the second coupling profile is arranged at the second edge;

the third coupling profile is arranged at the third edge; and the fourth coupling profile is arranged at the fourth edge.

3. The multi-purpose tile system according to claim 1, wherein at least one tile has a configuration wherein:

the first coupling profile is arranged at the second edge;

the second coupling profile is arranged at the first edge;

the third coupling profile is arranged at the third edge; and the fourth coupling profile is arranged at the fourth edge.

4. The multi-purpose tile system according to claim 1, wherein:

the first coupling profile comprises a sideward tongue extending in a direction substantially parallel to the upper side of the tile, the bottom front region of said sideward tongue, the bottom back region of said tongue being configured as bearing region, wherein the bottom back region is located closer to the level of the upper side of the tile than a lowest part of the bottom front region, and wherein the second coupling profile comprises a recess for accommodating at least a part of the sideward tongue of a further tile, said recess being defined by an upper lip and a lower lip, said lower lip being provided with a upwardly protruding shoulder for supporting and/or facing the bearing region of the sideward tongue, wherein the sideward tongue being designed such that locking takes place by an introduction movement into the recess of the sideward tongue a further tile and a angling down movement about an axis parallel to the first coupling profile, as a result of which a top side of the sideward tongue will engage the upper lip and the bearing region of the sideward tongue will be supported by and/or will be facing the shoulder of the lower lip, leading to locking of adjacent tiles at the first and second edges in both horizontal direction and vertical direction.

5. The multi-purpose tile system according to claim 1, wherein:

the third coupling profile comprises an upward tongue, at least one upward flank lying at a distance from the upward tongue and an upward groove formed between the upward tongue and the upward flank, wherein at least a part of a side of the upward tongue facing the upward flank is inclined toward the upward flank, and wherein at least a part of a side of the upward tongue facing away from the upward flank comprises at least one first locking element, which makes integral part of the upward tongue, and wherein the fourth coupling profile comprises a downward tongue, at least one downward flank lying at a distance from the downward tongue, and a downward groove formed between the downward tongue and the downward flank, wherein at least a part of a side of the downward tongue facing the downward flank is inclined toward the downward flank, and wherein the downward flank comprises at least one second locking element, which makes integral part of the downward flank, and adapted for co-action with the at least one first locking element of the third coupling profile of yet a further tile, the third and fourth coupling profiles being designed such that locking takes place during angling down of a tile to be coupled at the first coupling profile to the second coupling profile of a further tile, wherein the fourth coupling profile of the tile to be coupled makes a scissoring movement toward a third coupling profile of yet another tile, such that the downward tongue of the fourth coupling profile of the tile to be coupled will be forced into the upward groove of the third coupling profile of said other tile and the upward tongue of said other tile will be forced into the downward groove of the tile the be coupled, by deformation of the third coupling profile and/or the coupling profile edge, leading to locking of adjacent tiles at the third and fourth coupling profiles in both horizontal direction and vertical direction.

6. The multi-purpose tile system according to claim 1, wherein the length of the first edge and the length of the second edge of a tile are substantially identical.

7. The multi-purpose tile system according to claim 1, wherein the length of the first edge and the length of the second edge of a tile are greater than the length of the third edge and the fourth edge of said tile.

8. The multi-purpose tile system according to claim 1, wherein the first acute angle and the second acute angle are situated between 30 and 60 degrees.

9. The multi-purpose tile system according to claim 1, wherein the first obtuse angle and the second obtuse angle are situated between 120 and 150 degrees.

10. The multi-purpose tile system according to claim 1, wherein at least one pair of opposing edges of a tile are provided, near the top side, with a bevel.

11. The multi-purpose tile system according to claim 1, wherein each strip shaped upper substrate comprises:

a decorative layer and an abrasion resistant wear layer covering said decorative layer, wherein a top surface of said wear layer is the top surface of said tile, and wherein the wear layer is a transparent and/or translucent material, such that decorative layer is visible through the transparent wear layer, and wherein each bevel provided at facing longitudinal edges of at least two strip shaped upper substrates is formed by a cut-away portion and/or imprinted portion of said wear layer, and, a transparent finishing layer situated in between the decorative layer and the wear layer, and a back layer situated in between the base layer and the decorative layer.

12. The multi-purpose tile system according to claim 1, wherein each strip shaped upper substrate comprises a substantially transparent or translucent three-dimensional embossing structure at least partially covering said print layer.

13. The multi-purpose tile system according to claim 1, wherein each of the plurality of upper substrates comprises a decorative layer, wherein the decorative layers of at least two adjacently arranged upper substrates have different appearances.

14. The multi-purpose tile system according to claim 1, wherein at least one filler of the base layer is selected from the group consisting of: talc, chalk, wood, calcium carbonate, and a mineral filler.

15. The multi-purpose tile system according to claim 1, wherein a side of the downward tongue facing away from the downward flank is provided with a third locking element, and wherein the upward flank is provided with a fourth locking element, said third locking element being adapted to cooperate with a fourth locking element of another tile.

16. The multi-purpose tile system according to claim 1, wherein distinctive visual markings are applied to different tile types.

17. The multi-purpose tile system according to claim 1, wherein the decorative layer is formed by an ink layer digitally directly printed onto a supporting layer.

18. A tile covering comprising mutually coupled tiles of the multi-purpose tile system according to claim 1.

* * * * *